US007992625B1

(12) United States Patent
Spokoiny et al.

(10) Patent No.: US 7,992,625 B1
(45) Date of Patent: Aug. 9, 2011

(54) FLUID-OPERATED HEAT TRANSFER DEVICE

(75) Inventors: Michael Spokoiny, Chico, CA (US); James M. Kerner, Chico, CA (US); Xinliang Qiu, Chico, CA (US); James W. Maurus, Chico, CA (US); Boris M. Spokoyny, Chico, CA (US)

(73) Assignee: United States Thermoelectric Consortium, Chico, CA (US)

( * ) Notice: Subject to any disclaimer, the term of this patent is extended or adjusted under 35 U.S.C. 154(b) by 1197 days.

(21) Appl. No.: 11/506,726

(22) Filed: Aug. 18, 2006

(51) Int. Cl.
*F28F 7/00* (2006.01)
*H05K 7/20* (2006.01)

(52) U.S. Cl. ..... 165/80.4; 165/104.33

(58) Field of Classification Search ..... 165/80.4, 165/80.3, 104.33; 361/699; 257/714
See application file for complete search history.

(56) References Cited

U.S. PATENT DOCUMENTS 3,229,763 A 1/1966 Rosenblad
4,296,455 A * 10/1981 Leaycraft et al. ..... 361/691
4,938,280 A 7/1990 Clark
5,021,924 A 6/1991 Kieda
5,170,319 A 12/1992 Chu
5,183,104 A 2/1993 Novotny
5,220,804 A 6/1993 Tilton
5,224,538 A 7/1993 Jacoby
5,269,146 A 12/1993 Kerner
5,412,536 A 5/1995 Anderson
5,586,866 A * 12/1996 Wettstein ..... 416/96 A
5,774,334 A * 6/1998 Kawamura et al. ..... 361/699
5,781,411 A 7/1998 Feenstra
5,831,824 A 11/1998 McDunn
6,141,214 A 10/2000 Ahn
6,173,758 B1 1/2001 Ward
6,343,012 B1 1/2002 Rife
6,366,462 B1 * 4/2002 Chu et al. ..... 361/699
6,401,807 B1 6/2002 Wyler
6,431,260 B1 * 8/2002 Agonafer et al. ..... 165/80.4
6,469,898 B1 10/2002 Rouchon
6,650,538 B1 * 11/2003 Chu et al. ..... 361/688
6,666,260 B2 12/2003 Tantoush
6,671,172 B2 12/2003 Carter
6,729,383 B1 5/2004 Cannell
6,817,405 B2 11/2004 Kamath
6,820,684 B1 11/2004 Chu
6,914,782 B2 7/2005 Ku
6,940,718 B2 9/2005 Gedamu
6,973,801 B1 12/2005 Campbell (Continued)

OTHER PUBLICATIONS

Ekkad et al., Dimple Enhanced Heat Transfer in High Aspect Ratio Channels, J. Enhanced Heat Trans., 2003, pp. 395-405, vol. 10(4).

(Continued)

*Primary Examiner* — Tho v Duong
(74) *Attorney, Agent, or Firm* — The Webostad Firm

(57) ABSTRACT

Method and apparatus for heat transfer are described. In particular, a heat transfer device includes a housing having input and output ports for ingress and egress of a medium. The housing defines an interior volume with a first portion having pins extending therein and a second portion defined in part by a network of micro-channels. An interface between the first portion and the second portion of the interior volume has orifices for providing passageways for flow of the medium therebetween. A first portion of the pins are spaced apart from the interface to promote generation of vortices of the medium in the first portion of the interior volume.

19 Claims, 23 Drawing Sheets

U.S. PATENT DOCUMENTS

| | | | | |
|---|---|---|---|---|
| 6,988,534 | B2 | 1/2006 | Kenny | |
| 7,000,684 | B2 | 2/2006 | Kenny | |
| 7,188,662 | B2 * | 3/2007 | Brewer et al. | 165/80.4 |
| 7,255,153 | B2 * | 8/2007 | Berger et al. | 165/80.4 |
| 7,578,337 | B2 * | 8/2009 | Spokoiny et al. | 165/80.4 |
| 2003/0011987 | A1 | 1/2003 | Chu | |
| 2003/0183368 | A1 | 10/2003 | Paradis | |
| 2003/0226371 | A1 | 12/2003 | Rini | |
| 2004/0108101 | A1 | 6/2004 | Dugas | |
| 2004/0150956 | A1 | 8/2004 | Conte | |
| 2005/0047105 | A1 | 3/2005 | Gedamu | |
| 2006/0042825 | A1 | 3/2006 | Lu | |
| 2006/0092235 | A1 | 5/2006 | Sugahara | |
| 2006/0126296 | A1 | 6/2006 | Campbell | |

OTHER PUBLICATIONS

Isaev et al., Numerical Analysis of the Jet-Vortex Pattern of Flow in a Rectangular Trench, J. Eng. Phys. & Thermophys., 2003, pp. 61-69, vol. 76(1).

Patrick, W.V., Computations of Flow Structures and Heat Transfer in a Dimpled Channel at Low to Moderate Reynolds Number, Apr. 25, 2005, Master's Thesis, Virginia Polytechnic Institute and State University.

Syred et al., Effect of Surface Curvature on Heat Transfer and Hydrodynamics Within a Single Hemispherical Dimple, J. Turbomachinery, pp. 609-613, vol. 123.

* cited by examiner

FLUID-OPERATED HEAT TRANSFER DEVICE

FIELD OF THE INVENTION

One or more aspects of the invention relate generally to heat transfer and, more particularly, to a fluid-operated heat transfer device for use in a thermal control system.

BACKGROUND OF THE INVENTION

A continuing trend in the electronics, automobile, avionics, and spacecraft industries, among other industries, is to create more and more compact apparatuses leading to an increase in the power density of such apparatuses. Accordingly, as the power density of such apparatuses increases, there may be a corresponding increase in thermal energy to be dissipated for operability of such apparatuses. Notably, the size of such apparatuses, as well as the systems in which they are implemented, may impose additional constraints on the size of heat transfer devices used to transport such heat away.

Thus, the increase in power density of high-heat flux devices can make demands on heat transfer devices more acute. This additional demand on the ability to transport heat is further exacerbated by generally smaller dimensions utilizable for such heat transfer devices. Some examples of high-heat flux devices include microprocessors, graphics processing units, power handling semiconductors, lasers, programmable logic devices, motherboards, and digital signal processors, among other known high-heat flux devices.

Conventional heat transfer devices include passage ways by which a media, such as fluid, is flowed to transport heat. As a result of an increase in the amount of thermal energy to be transported, complexity associated with heat transfer devices has increased. This increase in complexity has generally led to an increase in hydrodynamic losses associated with fluid passing through such heat transfer devices. The increase in hydrodynamic losses has generally resulted in an increase in the consumption of energy for operation of the heat transfer devices themselves.

Accordingly, it would be desirable and useful to provide means for enhancing heat transfer but without the degree of hydrodynamic losses associated with prior heat transfer devices.

SUMMARY OF THE INVENTION

One or more aspects of the invention generally relate to heat transfer and, more particularly, to a fluid-operated heat transfer device for use in a thermal control system.

An aspect of the invention is a heat transfer device including a chambered heat exchanger having interior surfaces defining an interior volume, where the chambered heat exchanger has an inlet and an outlet for passage of liquid into and out of the interior volume. The chambered heat exchanger further includes: first pins extending from a first interior surface of the interior surfaces; first contours of a second interior surface of the interior surfaces being spaced apart from and at least substantially vertically aligned with ends of the first pins; a portion of the first contours having first orifices extending from the second interior surface through to a third interior surface of the interior surfaces; and the third interior surface having a network of micro-channels intersecting the orifices. The network of micro-channels has micro-channel passages with a hydraulic diameter in a range of approximately 0.2 mm to 3.5 mm.

Another aspect of the invention is heat transfer device including a housing having input and output ports for ingress and egress of a medium. The housing defines an interior volume. A first portion of the interior volume has pins extending therein, and a second portion of the interior volume is defined in part by a network of micro-channels. An interface between the first portion of the interior volume and the second portion of the interior volume has orifices for providing passageways for flow of the medium between the first portion and the second portion. A first portion of the pins are spaced apart from the interface to promote generation of vortices of the medium in the first portion of the interior volume.

Yet another aspect of the invention is a method of heat transfer. A medium is pumped into a heat transfer device. The medium is provided with a first set of parameters. The heat transfer device has an interior pin region coupled to an interior micro-channel region via orifices defined by a member of the heat transfer device. The member has a first side for defining in part the interior pin region and a second side for defining in part the interior micro-channel region. A flow of the medium occurs in the heat transfer device responsive to the pumping of the medium therein. The flow includes horizontal flow between pins of the heat transfer device in the interior pin region; vertical flow between the pins of the heat transfer device in the interior pin region; and swirling flow at least proximal to the orifices. In-micro-channel flow of the medium in the interior micro-channel region is affected by vortices associated with the swirling flow in the interior pin region to assist flow rate of the in-micro-channel flow. The medium exits the heat transfer device with a second set of parameters.

BRIEF DESCRIPTION OF THE DRAWINGS

Accompanying drawing(s) show exemplary embodiment (s) in accordance with one or more aspects of the invention; however, the accompanying drawing(s) should not be taken to limit the invention to the embodiment(s) shown, but are for explanation and understanding only.

DETAILED DESCRIPTION OF THE DRAWINGS

A relatively high-efficiency heat transfer device is described having a pin-dimple and dimple-micro-channel configuration of a heat sink structure. In the following description, numerous specific details are set forth to provide a more thorough description of the specific embodiments of the invention. It should be apparent, however, to one skilled in the art, that the invention may be practiced without all the specific details given below. In other instances, well known features have not been described in detail so as not to obscure the invention. For ease of illustration, the same number labels are used in different diagrams to refer to the same items; however, in alternative embodiments the items may be different.

Figure 1A:
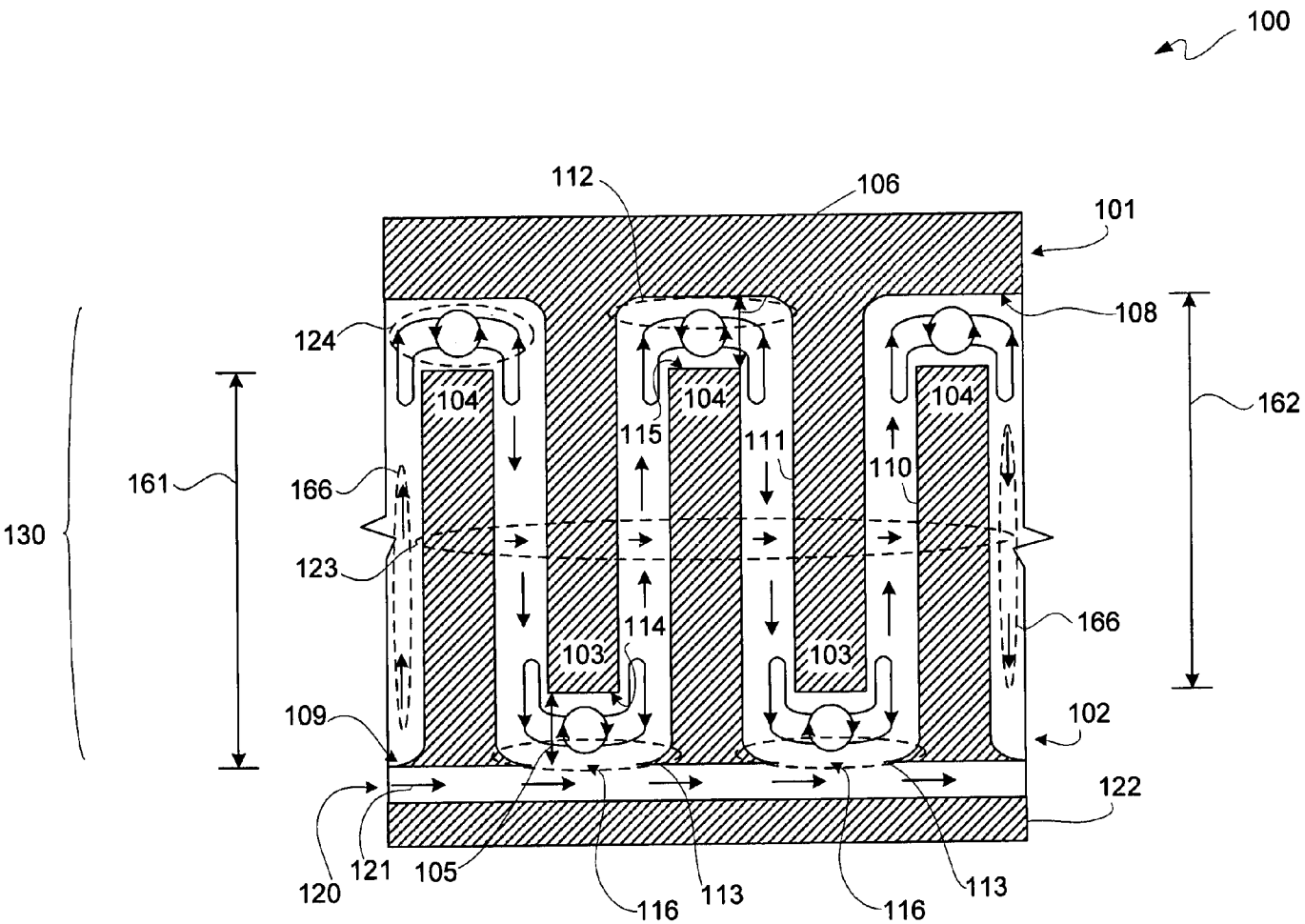
FIG. 1A is a cross-sectional view depicting an exemplary embodiment of a portion of a heat transfer device.

FIG. 1A is a cross-sectional view depicting an exemplary embodiment of a portion of a heat transfer device 100. Heat transfer device 100 in this example includes an upper plate 101 and a lower plate 102. Notably, the terms "upper" and "lower" are used merely to clearly designate the two plates in the several figures, and are not used to indicate any particular orientation for applied usage. Thus, heat transfer device 100 may be used in any orientation.

Upper plate 101 includes pins 103. Pins 103 generally extend from upper plate 101 in a downward direction toward lower plate 102. Lower plate 102 includes pins 104. Pins 104 generally extend from lower plate 102 in an upward direction toward upper plate 101. It should be understood that pins 103 and 104 extend toward plates 102 and 101, respectively, but are spaced apart from such plates. This spacing with reference to pins 103 and lower plate 102 is generally indicated as distance 105. Additionally, the separation of pins 104 from upper plate 101 is generally indicated as distance 106. Distance 105 is generally measured from end surfaces ("ends") 114 of pins 103 to an interior surface 109 of lower plate 102. Distance 106 is generally measured from ends 115 of pins 104 to an interior surface 108 of upper plate 101. More particularly, distances 105 and 106 are bounded by ends of pins 103 and 104, respectively, and interior surfaces 109 and 108, respectively, as associated with respective dimples. Additionally, pins 104 have a length 161 and pins 103 have a length 162.

Notably, heat transfer device 100 may have one set of pins and one set of corresponding dimples. Dimples 112 are formed to provide concave or recess contours ("dimples") as part of the contour of interior surface 108. For example, a top plate may have pins extending therefrom and a bottom plate may have dimples, at least a portion of which correspond to ends of the pins. Such bottom plate need not have pins in this implementation. However, for purposes of clarity by way of example and not limitation, overlapping and spaced apart pins extending from both upper and lower plates is described.

In this example, upper plate 101 and lower plate 102 are machined from respective solid pieces of material, such as copper, aluminum, or other known material for use in heat transfer. Thus, interior surface 109 of lower plate 102 may be contiguous with side surfaces 110 of pins 104. Moreover, interior surface 108 of upper plate 101 may be contiguous with side surfaces 111 of pins 103. However, machining from solid pieces of material need not be used, and other manufacturing techniques, such as molding, stamping, or coining, may be used with or without machining. This may further facilitate using other types of materials, such as carbon fiber for example.

Dimples 112 and 113 are part of interior surfaces 108 and 109 of upper plate 101 and lower plate 102, respectively. These dimples 112 and 113 may be formed, in whole or in part, as a byproduct of the formation of pins, such as pins 103 and 104, respectively, or vice versa. Dimples 113 are formed to provide part of the contour of interior surface 109. Notably, ends 114 of pins 103 are generally centered with respect to dimples 113. Moreover, ends 115 of pins 104 are generally centered with respect to dimples 112. Thus, it should be appreciated that ends and dimples are spaced apart and are at least substantially coaxially aligned with respect to vertical orientation.

Formed in lower plate 102, or in a sealing plate 122 coupled to bottom plate 102, or in a combination thereof, may be a network of micro-channels as generally indicated in FIG. 1A by micro-channel 120. In this particular example, micro-channel 120 is formed in bottom plate 102. Formation of micro-channel 120 proximate to dimples 113 forms orifices 116. Micro-channel 120 provides a passageway for fluid, generally indicated by arrows 121.

The network of micro-channels bounded on at least two sides by sealing plate 122 and lower plate 102 defines a portion of an interior volume of heat transfer device 100. Another portion ("interior region") 130 of an interior volume of heat transfer device 100 is bounded on at least two sides by upper plate 101 and lower plate 102. Fluid 121 may flow in an inlet (not shown in FIG. 1A) into interior region 130 before flowing into micro-channels 120 and flow out of micro-channels 120 into interior region 130 before flowing out via an outlet (not shown in FIG. 1A). In other words, generally an inlet and an outlet are used for fluid to flow into and out of an interior region 130, and then from interior region 130 into and out of micro-channels 120.

Fluid 121, as generally indicated by arrows of FIG. 1A, may be in micro-channel 120, as well as an interior region 130, namely the interior region where pins 103 and 104 are present. Again, it should be appreciated that pins 103 and 104 are spaced apart. Additionally, portions of pins 103 and 104 may be generally interposed. Thus, projections of pins 103 and 104 into interior region 130 overlap in a generally vertical direction. Accordingly, exterior surfaces of pins 103 and 104 with reference to one another or with reference to an opposing interior surface 109 and 108, respectively, may define channels, which may generally be thought of as "main" channels. Notably, main channels are not micro-channels as used herein.

Fluid 121 may flow between pins 103 and 104 in interior region 130, for example in a substantially horizontal direction as indicated by arrows 123. In other words, fluid 121 may weave in and out between pins 103 and 104 in a direction generally transverse to orientation of pins 103 and 104. Additionally, fluid 121 may flow up and down between pins 103 and 104 as generally indicated by arrows 166. In other words, fluid 121 may weave in and out between pins 103 and 104 in a direction generally axial to orientation of pins 103 and 104.

The location of ends 114 with respect to dimples 113 and of ends 115 with respect to dimples 112 promotes the creation of vortices in flow of fluid 121 as indicated by circled regions ("vortices") 124. Thus, swirling movement of fluid between ends 114 and interior surface 109 and between ends 115 and interior surface 108 is generated by pumping fluid 121 into interior region 130. It should be understood that vortices 124 may extend away from dimples 112 and 113 to be along part of the length of associated pins 103 and 104 proximal to associated ends 114 and 115, respectively.

While not wishing to be bound by theory, it is believed that vortices 124 at least proximate to, which may include extending into, orifices 116 influence the flow of fluid 121 in micro-channel 120. By creating vortices 124 affecting fluid flow in micro-channel 120 via orifices 116, flow rate of fluid 121 in micro-channel 120 may be accelerated by such swirling movements without having to correspondingly increase pressure provided by an external pump. While not wishing to be bound by theory, it is believed that this relationship between fluid flow in micro-channels 120 and fluid flow in interior region 130 is in effect a coupling of the two fluid flows via orifices 116, where fluid flow associated with vortices 124 proximal to orifices 116 propels or otherwise accelerated fluid flow in micro-channels 120. Notably, although generally uniform arrows are illustratively shown, it should be appreciated that fluid 121 flow in micro-channel 120, as well as in interior region 130, may generally be turbulent flow for purposes of removing heat. However, there may be some laminar flow too.

Figure 1B:
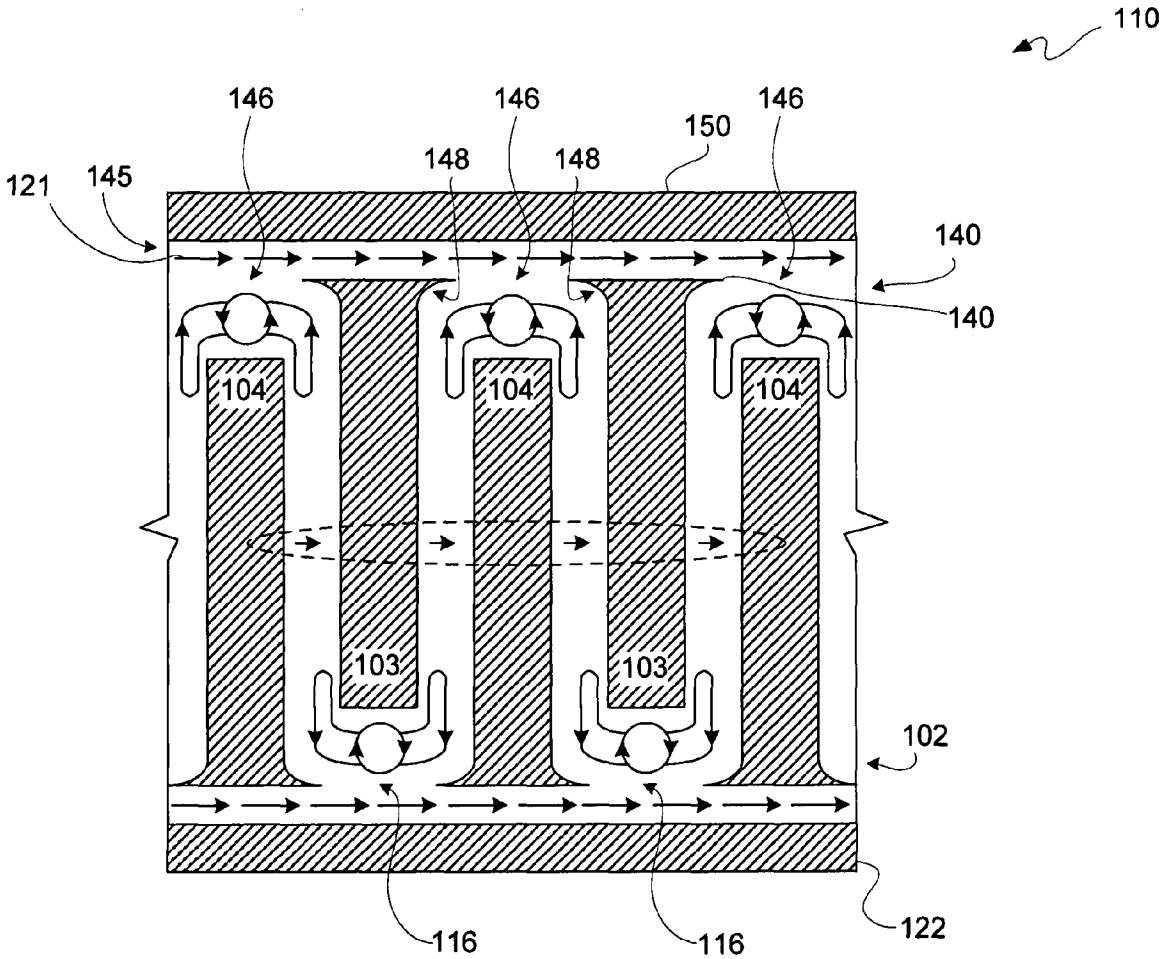
FIG. 1B is a cross-sectional view depicting an alternative exemplary embodiment of a portion of a heat transfer device.

FIG. 1B is a cross-sectional view depicting an alternative embodiment of a portion of a heat transfer device, namely a portion of a heat transfer device 110. Heat transfer device 110 of FIG. 1B is similar to heat transfer device 100 of FIG. 1A, and thus only the differences are described in order to avoid repetition.

Heat transfer device 110 of FIG. 1B includes an upper plate 140 and a sealing plate 150. Upper plate 140 may be formed as described with reference to lower plate 102 of FIG. 1A, except with pins 103 instead of pins 104. Sealing plate 150 may be formed like sealing plate 122 of FIG. 1A. Accordingly, a network of micro-channels, as generally indicated in FIG. 1B by micro-channel 145, may be formed in upper plate 140 for fluid 121 to flow.

Orifices 146 may be formed like orifices 116, namely responsive to the formation of micro-channel 145 such that interior surface 148 of upper plate 140 are perforated. Orifices 146 provide passageways from interior region 130 through to the interior of micro-channel 145. Again, while not wishing to be bound by theory, it is believed that fluid flow associated with vortices 124 affects fluid flow in micro-channel 145 via orifices 146, where swirling motion of fluid flow may accelerate flow rate of fluid 121 in micro-channel 145 by such swirling movements without having to correspondingly increase pressure provided by an external pump.

Figure 2A:
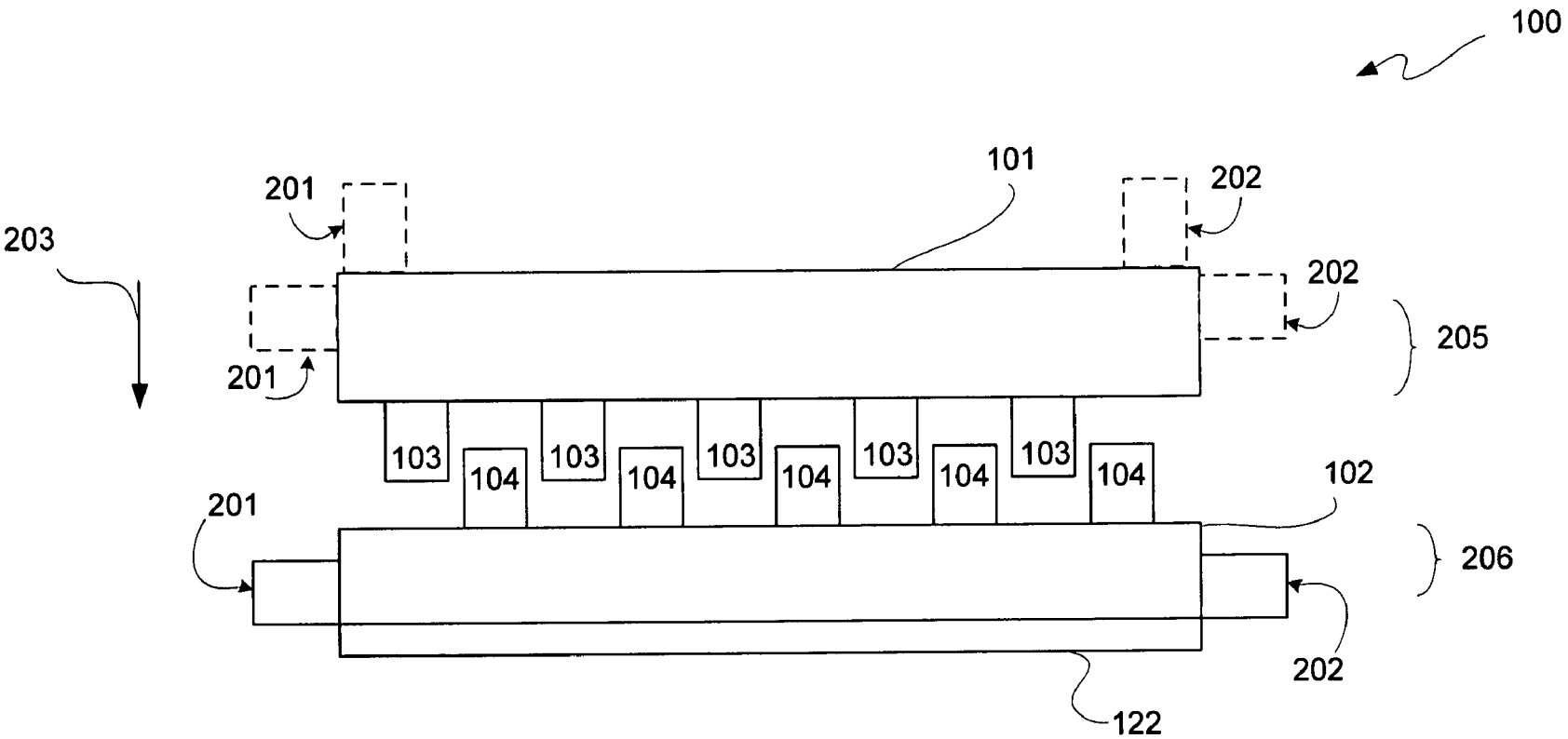
FIG. 2A is a side view depicting an exemplary embodiment of the heat transfer device of FIG. 1A prior to completed assembly thereof.

FIG. 2A is a side view depicting an exemplary embodiment of heat transfer device 100 prior to completed assembly thereof. As illustratively shown, fittings 201 and 202 may be affixed to lower plate 102 for respectively providing an inlet and an outlet to an interior region, such as interior region 130 of FIG. 1A for example. Upper plate 101 and lower plate 102 may be coupled to one another as generally indicated by arrow 203. For example, upper plate 101 may be coupled to lower plate 102 by solder, adhesive, mechanical fasteners, or any combination thereof depending on the application. Moreover, other types of fastening of plates may be used which may include one or more of brazing, welding, caulking, gluing, gasket material, and magnetic force, among other known types of fastening means. It shall be assumed for purposes of clarity by way of example and not limitation that upper and lower plates 101 and 102 are copper, and thus solder is used to couple them to one another. Furthermore, fittings 201 and 202 may be soldered to lower plate 102, or may be formed as part of lower plate 102, or other known form of attachment. Notably, alternative locations for fittings 201 and 202 are illustratively shown with respective dashed boxes.

As illustratively shown, pins 103 and 104 may be at least partially interposed with respect to one another. A portion of the vertical length of pins 103 may extend into a cavity region of lower plate 102 as defined in part by sidewalls 206 thereof. A portion of the vertical length of pins 104 may extend into a cavity region of upper plate 101 defined in part by sidewalls 205 thereof.

Figure 2B:
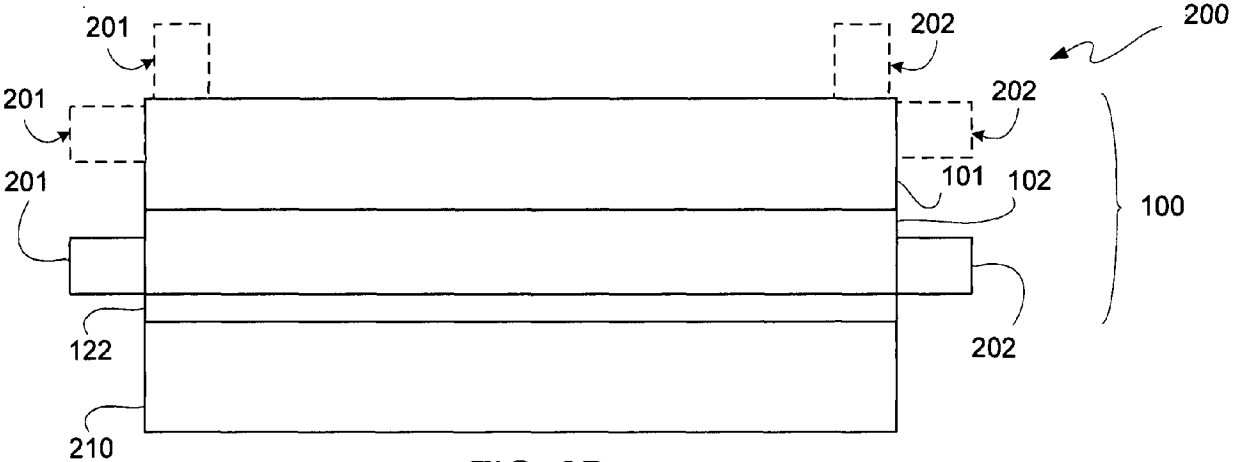
FIG. 2B is a side view depicting an exemplary embodiment of a heat transfer assembly.

FIG. 2B is a side view depicting an exemplary embodiment of a heat transfer assembly 200. FIG. 2B includes the side view of FIG. 2A after coupling upper plate 101 and lower plate 102 together. Upper plate 101 and lower plate 102 may be coupled prior to coupling sealing plate 122 to lower plate 102.

A block 210 has been put in contact with lower plate 102, and such block 210 may be coupled to lower plate 102, such as via a thermally conductive medium. Examples of thermally conductive media that may be used include thermal paste, solder, and other metals, among other known thermally conductive media. Block 210 is used to generally indicate an association with high heat flux device, such as an integrated circuit chip ("chip"), multi-chip module, or a heat sink for example. Thus, heat transfer assembly 200 of FIG. 2B may be for convective heat transfer from a chip, a multi-chip module, a heat sink, or other high heat flux-associated device. By high heat flux-associated device in this context, it is meant to include devices that produce high heat flux or devices/objects that conduct high heat flux or any combination thereof.

Figure 2C:
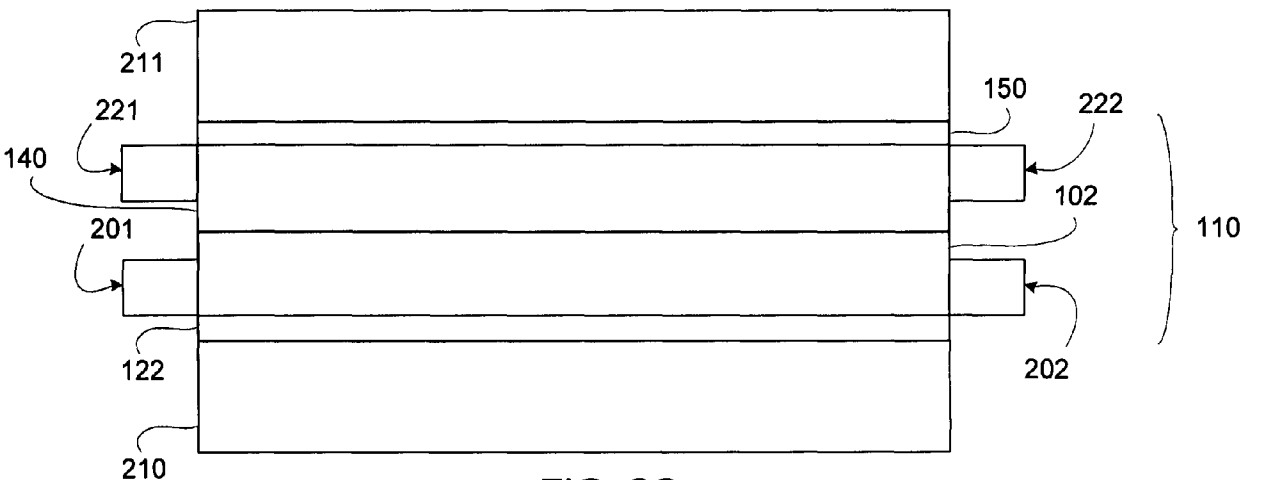
FIG. 2C is a side view depicting an exemplary alternative embodiment of a heat transfer assembly

FIG. 2C is a side view depicting an exemplary alternative embodiment of a heat transfer assembly, namely heat transfer assembly 220. Heat transfer assembly 220 is similar to heat transfer assembly 200 of FIG. 2B, and thus some description is not repeated. However, rather than heat transfer device 100 as illustratively shown in FIG. 2B, a heat transfer device 110 as described with reference to FIG. 1B is used. As previously described with reference to FIG. 1B, heat transfer device 110 has at least two separate networks of micro-channels. A block 211 may be coupled or put in contact with sealing plate 150 of heat transfer device 110. Block 211, like block 210, is used to generally indicate an association with a high heat flux device. Fittings 221 and 222 may be coupled to upper plate 140 to provide an inlet and an outlet to interior region 130 and then to a network of micro-channels 145 associated therewith. Thus, it should be appreciated that parallel conductive heat transfer may be provided in an implementation of heat transfer assembly 220.

Notably, either or both of heat transfer assemblies 200 and 220 may be implemented. However, it shall be apparent to one of ordinary skill in the art from the following description of an implementation of heat transfer assembly 200 that heat transfer assembly 220 may be implemented in a like manner.

Figure 3:
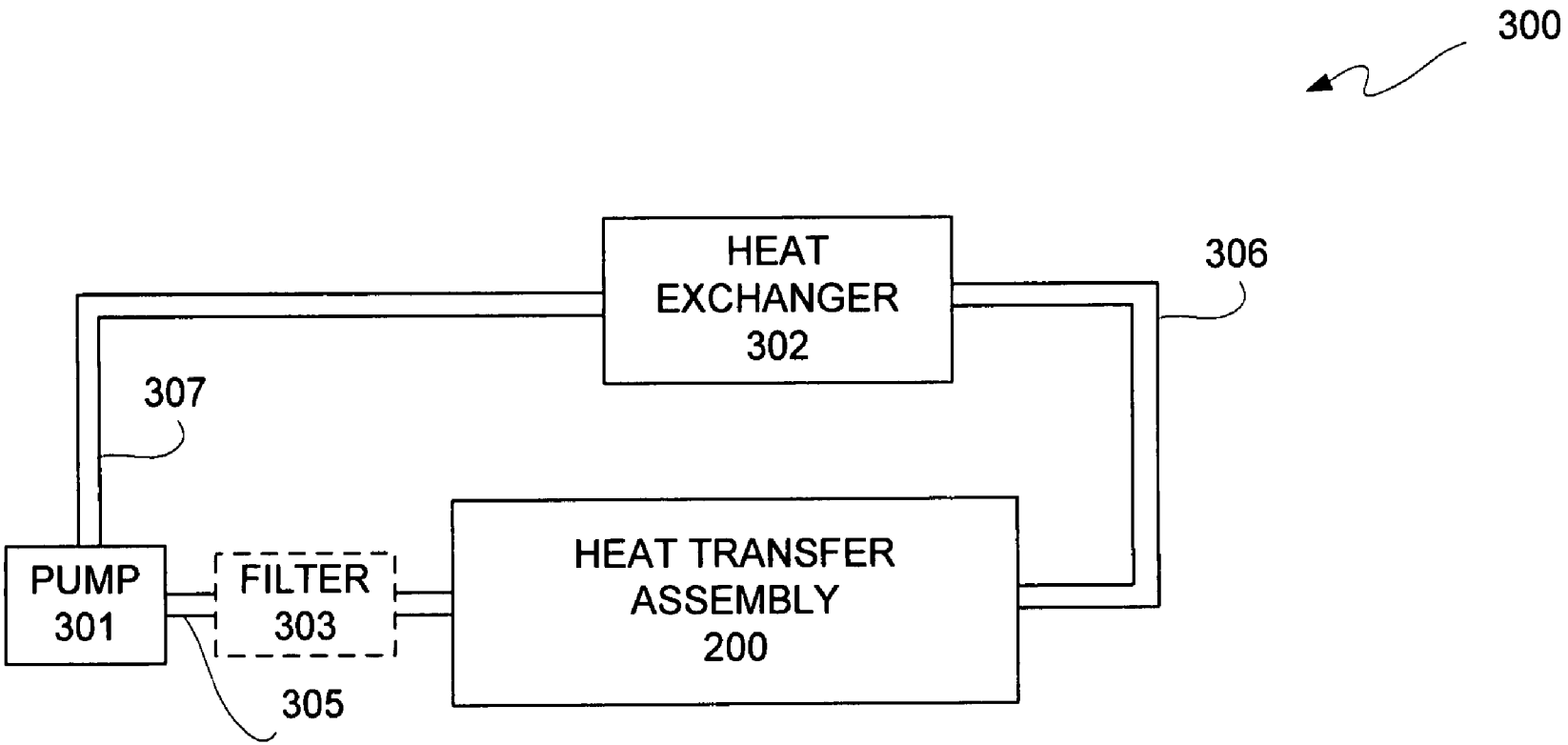
FIG. 3 is a block diagram depicting an exemplary embodiment of a heat exchange system.

FIG. 3 is a block diagram depicting an exemplary embodiment of a heat exchange system 300. Heat exchange system 300 includes heat exchanger 302, pump 301, and heat transfer assembly 200. Additionally, an optional inline filter 303 may be used. It shall be assumed that optional filter 303 is not included for purposes of clarity.

Pump 301 may be coupled to heat transfer assembly 200 via conduit 305. Conduit 305 may be composed of tubing or piping which may or may not be circular in cross section. Pump 301 pumps fluid to an inlet of heat transfer assembly 200. Notably, although it has been assumed that a single inlet is used, as well as a single outlet, it should be appreciated that multiple inlets, and outlets, may be used for heat transfer assembly 200.

Pump 301 may provide fluid into heat transfer assembly 200 with a wide range of pressure and flow rate. Notably, the dimensions of a heat transfer assembly may vary from application to application, and the amount of heat removal may vary from application to application. Thus, these ranges are merely illustrative of the exemplary implementations described below, which implementations are generally directed at cooling microprocessors. It should be appreciated that other integrated circuits, multi-chip modules, heat sinks, or other devices associated with high heat flux may have different thermal characteristics than microprocessors, and thus variation of the exemplary embodiments herein may be used to accommodate such differences in such other applications.

Fluid flow characteristics in heat transfer assembly 200 may generally be characterized by flow rate, pressure gradient, and Reynolds number ("Re"). While not wishing to be bound by theory, it is believed that vortices 124 of FIG. 1A generated inside heat transfer assembly 200 facilitate obtaining turbulent flow at a generally lower Re number than that obtainable for the conventional heat transfer devices at comparable conditions. Thus, for example for a micro-channel length in a range of approximately 4 to 30 mm with an equivalent micro-channel hydraulic diameter of approximately 0.2 to 1.0 mm for distilled water as a moving fluid in the example embodiments described below, laminar to turbulent flow transition may occur for Re in a range of approximately 1100 to 1700. While not wishing to be bound by theory, it is believed that the rate of heat transport in wattage dissipation per area may achieve up to approximately 100 watts/cm$^2$ at a temperature difference of approximately 50 degrees Kelvin or Celsius in the turbulent regime of flow and up to approximately 1000 watts/cm$^2$ for a boiling flow. Notably, even though the example is for a hydraulic diameter in a range of approximately 0.2 to 1.0 mm for micro-channels of a network of micro-channels, a hydraulic diameter for such micro-channels may be in a range of approximately 0.2 mm to 3.5 mm. Furthermore, while not wishing to be bound by theory, it is believed that a turbulent part of the turbulent flow is generated by bubbles originating from an evaporative medium, namely evaporated fluid, where the medium in contact with the heat transfer surface provide at least in part by interior pins is sufficiently hot to promote such evaporation.

FIG. 3 is described further with additional reference to FIGS. 1A and 2B. Fluid is pumped from pump 301 via conduit 305 to inlet 201 of heat transfer device 100. For the examples described below in additional detail, inlet and outlet hydraulic diameter may be in a range of approximately 2 to 16 mm.

Outlet 202 of heat transfer device 100 is coupled to conduit 306. Conduit 306 is used to couple fluid flow from heat transfer assembly 200 to heat exchanger 302. Notably, heat exchanger 302 in this example is shown having an output which is coupled to pump 301. However, a less direct coupling may be used. In fact, even though heat exchange system 300 is shown as a closed loop system, an open loop system may be used. Such an open loop system may be more common where heat exchanger 302 is part of an HVAC system of a building. Use with an HVAC system may be more prevalent in applications where multiple high heat flux blocks are used simultaneously, such as computer server system applications. Additionally, it should be appreciated that to promote energy conservation, heat transported from heat transfer assembly may be used for heating, such as providing hot water for example. However, for purposes of clarity, it shall be assumed that heat exchange system 300 is a closed loop system such as for cooling a microprocessor or other integrated circuit(s) of a personal computer.

Fluid output from heat exchanger 302 is provided to pump 301 via conduit 307. Thus, it should be appreciated that conduits 305 and 307 are associated with a cold side of heat exchange system 300, and conduit 306 is associated with a hot side of heat exchange system 300. Notably, conduits 305 through 307 may be the same or different from one another with respect to their composition or hydraulic diameter or any combination thereof.

As shall be appreciated from description of the example implementations below, micro-channels and orifices of heat transfer device 100 may be such that filter 303 is optional. Even though heat exchange system 300 may employ water, it should be appreciated that other types of fluids may be used, such as water/anti-freeze mixture, oil, or a dielectric fluid for example.

Figure 4A:
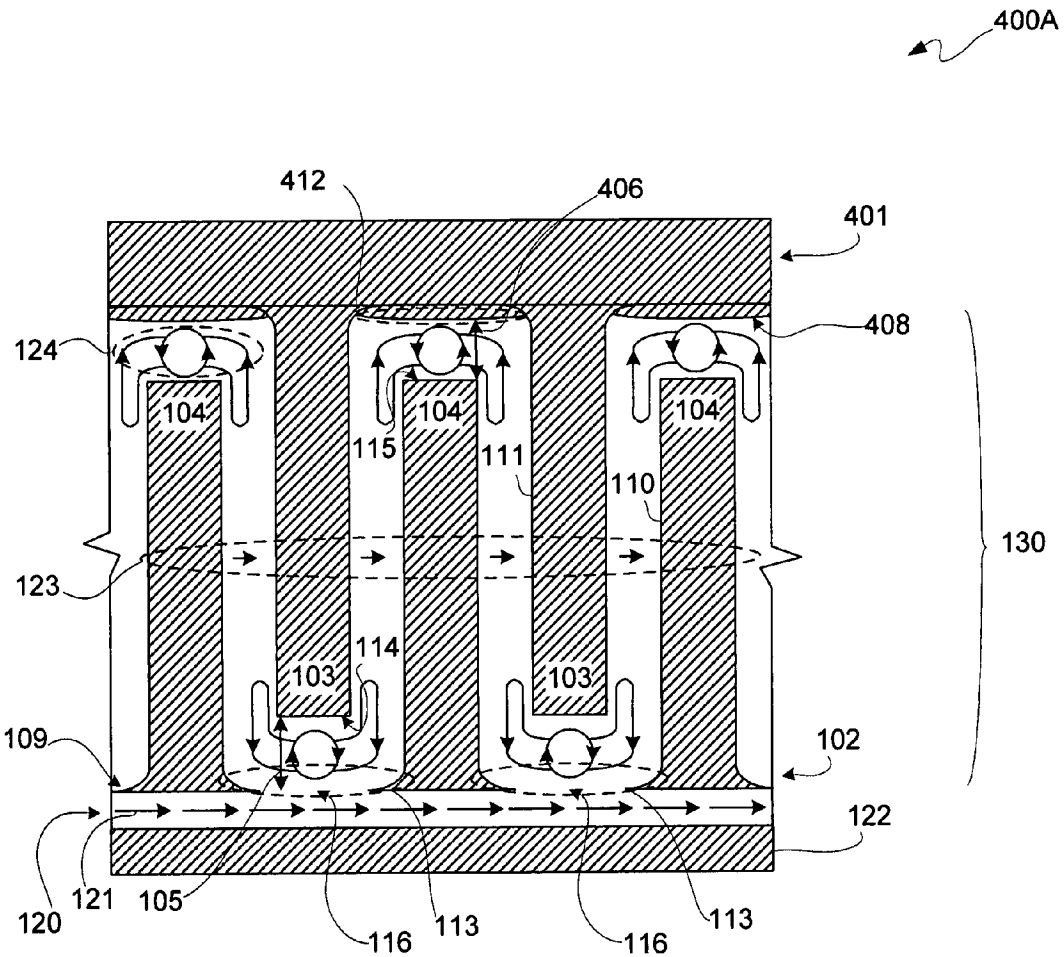
FIG. 4A is a cross-sectional view depicting another alternative exemplary embodiment of a portion of a heat transfer device.

FIG. 4A is a cross-sectional view depicting another alternative exemplary embodiment of a portion of a heat transfer device, namely heat transfer device 400A. Heat transfer device 400A of FIG. 4A is similar to heat transfer device 100 of FIG. 1A, and accordingly common description is not repeated.

Instead of dimples 112 associated with an upper plate, an upper plate 401 includes pimple contours ("pimples") 412. Pimples 412 may extend further into fluid passageways of interior region 130 than dimples 113 of lower plate 102. Notably, pimples may not be as effective as dimples for effecting transfer of heat via fluid flow. Furthermore, it should be appreciated that some or all associated interior surface areas may formed with neither pimples 412 nor dimples 113, as such interior surface areas may be generally flat with orifices, like orifices 116, to provide fluid passageways between an interior region 130 and a network of micro-channels.

Distance between ends 115 of pins 104 and interior surface 408 of upper plate 401 as associated with pimples 412, namely distance 406, may be less than distance 106 of FIG. 1A. However, it should be appreciated that either dimples or pimples, or both, may be used for generating vortices 124. Furthermore, it should be appreciated that a combination of dimples and pimples may be implemented in a heat transfer device, such as heat transfer device 400A for example.

Figure 4B:
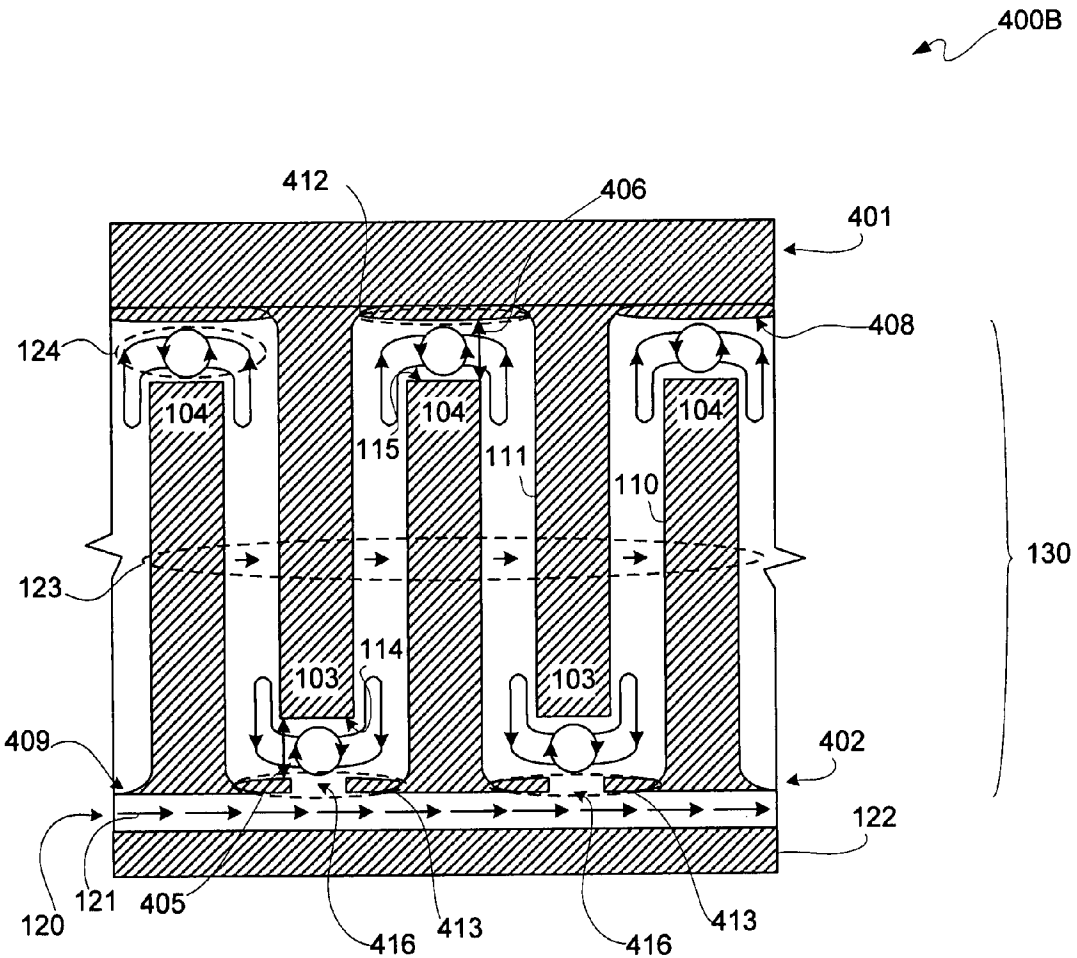
FIG. 4B is a cross-sectional view depicting yet another alternative exemplary embodiment of a heat transfer device.

FIG. 4B is a cross-sectional view depicting yet another alternative exemplary embodiment of a heat transfer device, namely heat transfer device 400B. Heat transfer device 400B is similar to heat transfer device 400A of FIG. 400A and heat transfer device 100 of FIG. 1A, and thus common description is not repeated.

Lower plate 402 includes pimples 413. Pimples 413 of FIG. 4B replace dimples 113 of FIG. 4A. Orifices 416 may be made through pimples 416 to provide passageways between interior region 130 and micro-channel 120. Distance between ends 114 of pins 103 and interior surface 409 as associated with pimples 413, namely distance 405, may be less than distance 105 of FIG. 1A. However, vortices 124 may be generated at least in part between ends 114 and interior surface 409 of lower plate 402 as associated with pimples 413, and may extend in part along a portion of the side or sides of associated pins. Again, orifices 416 provide fluid passageways allowing fluid flow of vortices 124 to affect flow of fluid 121 in micro-channel 120, namely for accelerating fluid flow in micro-channel 120.

With reference to FIGS. 1A, 1B, 4A, and 4B, it should be appreciated that there is distance between ends of pins and either an inner surface of pimples 412 or 413 or an inner surface of a dimple 112 or 113, with or without an orifice 116, 146, or 416 associated therewith. This spacing may vary from application to application. However, while not wishing to be bound by theory, it is believed that for generating vortices in turbulent fluid flow, spacing between ends of pins and associated dimples or pimples should be approximately 0.5 to 4.0 mm. Furthermore, while not wishing to be bound by theory, it is believed that length of pins should be in a range of approximately 0.8 to 24 mm to provide an effective heat transfer with turbulent flow of fluid 121 in interior region 130.

Figure 5A:
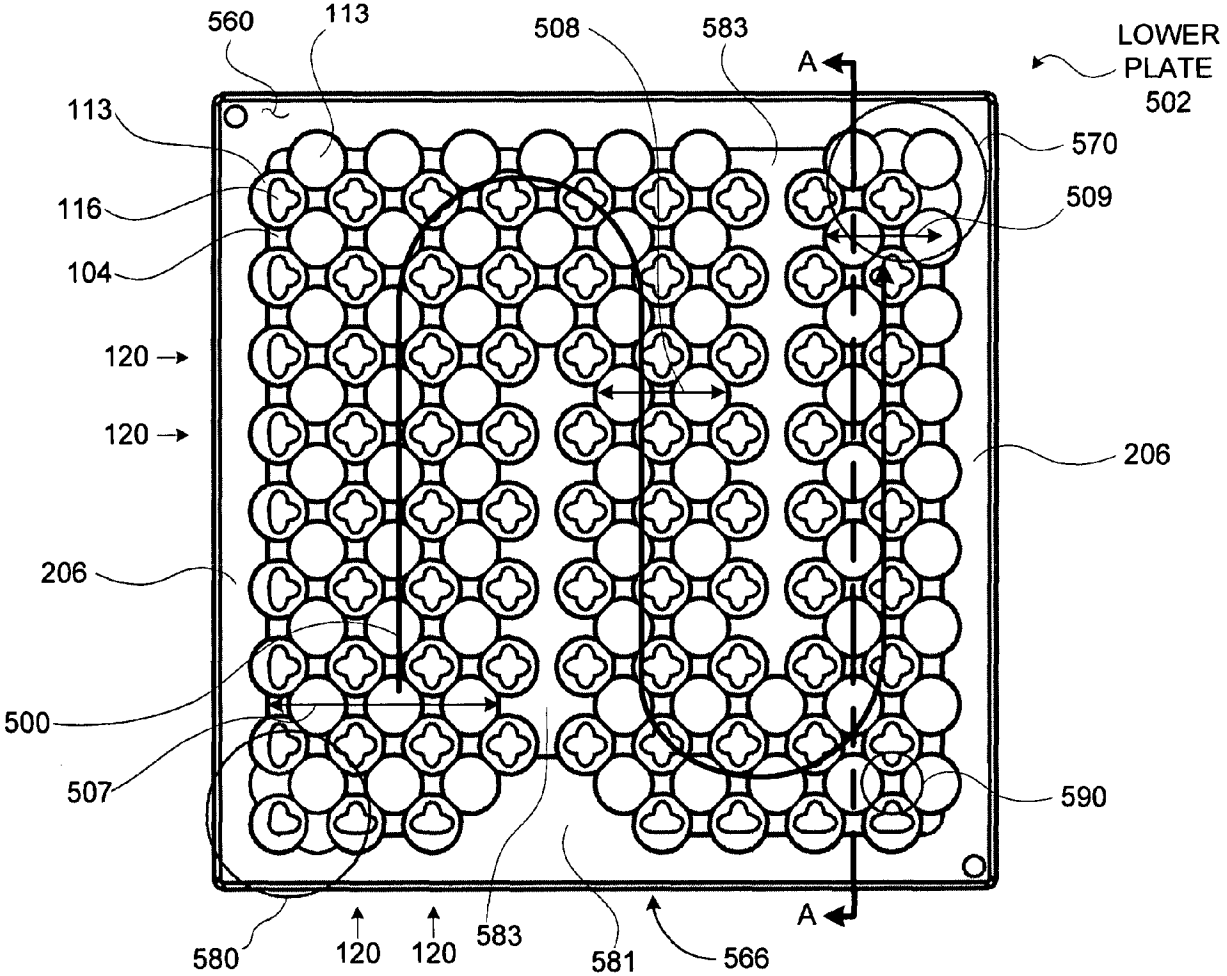
FIG. 5A is a top plan view depicting an exemplary embodiment of a lower plate of a heat transfer device.

FIG. 5A is a top plan view depicting an exemplary embodiment of a lower plate 502. Lower plate 502 may be implemented as part of a heat transfer assembly, such as previously described with reference for example to FIG. 2B or heat transfer device such as previously described with reference for example to FIG. 1A. As an upper plate counterpart to lower plate 502 may be understood from the prior description and the following additional description of lower plate 502, repetitious description of an upper plate is avoided for purposes of clarity.

Lower plate 502 includes dimples 113, pins 104, and fluid flow dams 583. Notably, some dimples 113 include orifices 116, while other dimples 113 do not include orifices 116. It should be appreciated that vortices, such as vortices 124 as described elsewhere herein, may be generated in both forms of dimples; however, dimples 113 having orifices 116 provide passageways for some confluence of fluid flow in an interior region, such as interior region 130 of FIG. 1A for example, with fluid flow in micro-channels 120. Notably, circular dimples 113 are illustratively shown; however, the shape of openings of dimples may be circular, elliptical, or polygonal, and any combination of these types of dimples may be used.

Notably, fluid may flow, for example, from left to right across lower plate 502. It should be understood that this fluid flow may start generally at a bottom left corner of lower plate 502 and proceed to an upper right corner of lower plate 502. Furthermore, it should be understood that as fluid flows across lower plate 502, such fluid when entering lower plate 502 has a significantly lower temperature than when exiting lower plate 502 when in use with a high heat flux device. In order to provide for a more uniform temperature gradient surficially across lower plate 502, fluid flow dams 583, which may have counterparts as part of an upper plate, may be used to direct fluid flow within lower plate 502. More particularly with respect to an interior region associated with lower plate 502, such as interior region 130 as previously described for example with reference to FIG. 1A, fluid flow may have a serpentine path as generally indicated by arrow 500.

Notably, the transverse spacing between a right interior surface of a left sidewall 206 and a left interior surface of a left fluid flow dam 583, generally indicated by arrow 507, is wider than the transverse spacing between fluid flow dams 583, generally indicated by arrow 508. This is because the cooler fluid entering lower plate 502 may be more widely dispersed for providing uniform cooling when generally initially received and less widely dispersed as such fluid moves through an interior region associated with lower plate 502 and becomes hotter. Furthermore, the transverse spacing between a left interior surface of right side fluid flow dam 583 and a left interior surface of a right sidewall 206 of lower plate 502, generally indicated by arrow 509, is narrower than the transverse spacing 508 between fluid flow dams 583. Thus, it should be appreciated that fluid flow dams 583 may be sufficiently tall that the interior region of a heat transfer device may be chambered such as for providing a more uniform temperature gradient surficially across a heat transfer device in connection with cooling a high heat flux device.

In this particular example, a serpentine fluid flow is used as generally indicated by arrow 500. However, other types of fluid flow may be used. Furthermore, depending on the application, it may be determined that more cooling is needed in one area than in another area of a high heat flux block, and accordingly, fluid flow dams may be positioned to accommodate different cooling needs associated with a high heat flux block.

In this example, a peninsula region 581 is provided and may be used as part of fluid flow dam 583. However, it should be appreciated that holes (not shown) may be formed in peninsula region 581 for coupling monitoring wires to monitor temperature.

For a microprocessor application, dimples 113 may be spaced apart by approximately 0.2 to 10 mm on center. Additionally, diameter of dimples 113 may be approximately 0.5 to 5.0 mm, and depth of dimples 113 may be approximately 0.25 to 2.50 mm. Furthermore, distance from the bottom of an interior surface of a dimple 113 to an end 115 of a pin 104, not shown in FIG. 5A but illustratively shown as distance 597 in FIG. 5E below, may be approximately 1.5 to 35.0 mm. Lastly, orifices 116 may have a diameter in a range of approximately 0.2 to 5.0 mm. Notably, if pimples are used instead of or in addition to dimples, then with reference to FIG. 4A or 4B for example, pimples 413 may be spaced apart by approximately 0.2 to 10 mm on center for a microprocessor application. Additionally, diameter of pimples 413 may be approximately 0.5 to 5.0 mm, and height of pimples 413 may be approximately 0.25 to 2.50 mm.

It should be appreciated that surface 560 is an upper interior surface of lower plate 502. Bottom interior surface 109 of FIG. 1A may be at a different height than upper interior surface 560. Areas 570, 580, and 590 of FIG. 5A are enlarged and described in further detail in the several following figures.

Additionally, it should be appreciated that pressure may drop as a fluid moves from an inlet to an outlet. Additionally, it should be appreciated that fluid velocity may vary as fluid moves from an inlet to an outlet. Thus, to provide effective heat transfer from a heat source having a non-uniform temperature field, there may be generally more micro-channels closer to an outlet in comparison to the number of micro-channels closer to an inlet or vice versa. Thus, it should be appreciated that micro-channel distribution may be uniform, non-uniform, or any combination thereof, and thus may be adapted to the temperature field of target heat source application.

Figure 5C:
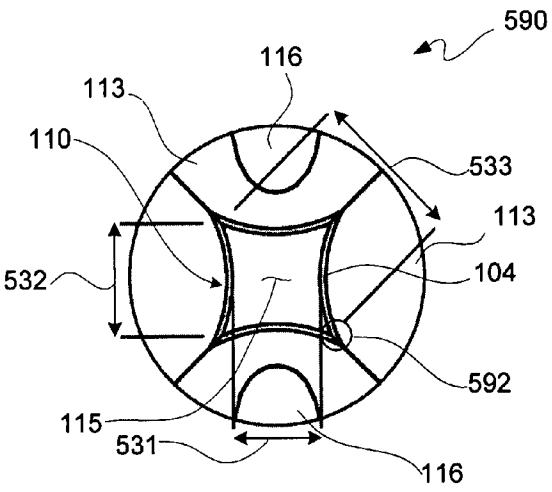
FIG. 5C is an enlarged view of another area of the lower plate of FIG. 5A.
Figure 5B:
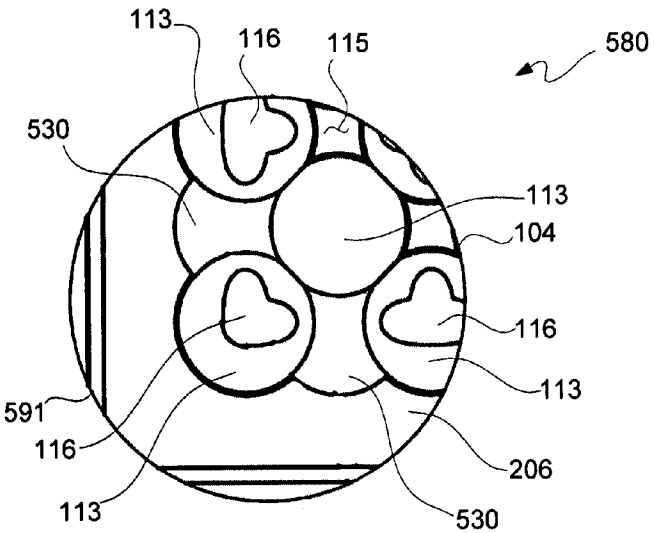
FIG. 5B is an enlarged view of an area of the lower plate of FIG. 5A.

FIG. 5B is an enlarged view of area 580 of FIG. 5A. In addition to dimples 113, plunged areas 530 may be formed. Furthermore, lower plate 502 may include a chamfer 591 around sidewalls 206.

FIG. 5C is an enlarged view of area 590 of FIG. 5A. In this example, pin 104 is shown as having a generally diamond-like or star-like shape with flared or finned corners ("fins") 592 and curved sidewalls 110. It should be understood that by having curved sidewalls 110, surface area may be increased, which promotes heat transfer and may promote generation of vortices. However, it should be appreciated that the particular shape illustratively shown in this example need not be used and any other shape may be used in accordance with the description herein. For example, frustums, or cylinders with polygonal, circular, or elliptical cross-sections, may be used. However, it should be appreciated that some shapes, namely those with larger surface areas, may be better at promoting heat transfer. Furthermore, it should be appreciated that shapes with corners, with or without fins 592, may be more suited for promoting turbulent fluid flow. In this particular example size of pin 104, namely size 533, is approximately 0.5 to 5.5 mm. Furthermore, outer width 532 is approximately 0.35 to 4.00 mm for this example, and inner width 531 is approximately 0.35 to 4.00 mm for this example.

Figure 5D:
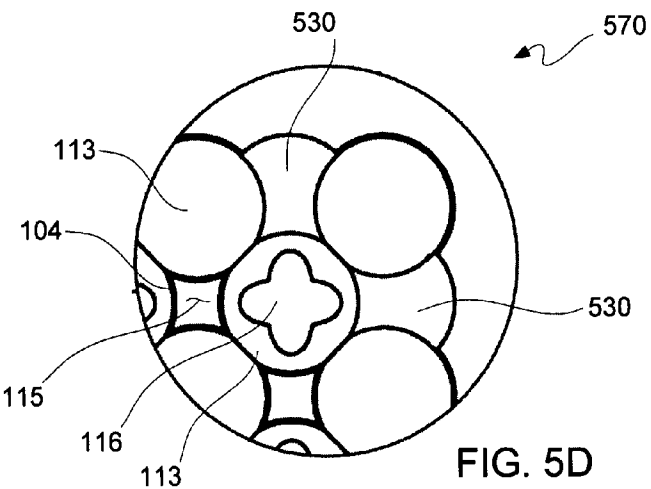
FIG. 5D is an enlarged view of yet another area of the lower plate of FIG. 5A.

FIG. 5D is an enlarged view of area 570 of FIG. 5A. In this example, orifice 116 is provided by the intersection of two micro-channels which in combination with an associated dimple 113 provide a passageway from interior to exterior surfaces of lower plate 502. Notably, in FIG. 5B, there is shown a generally heart-shaped orifice 116 which is also caused by the intersection of two micro-channels, but at a corner intersection, intersecting an associated dimple. Furthermore, in FIG. 5B, there is a generally "T"-shaped orifice 116 which is caused by the intersection of two micro-channels, though at a side intersection. These two orifices 116 as illustratively shown in FIG. 5B are in contrast to cross-like or "+"-shaped orifice 116 as illustratively shown in FIG. 5D, which is formed by the intersection of a dimple and two micro-channels, not at a corner or T intersection of such micro-channels but at a "four way" intersection.

Figure 5E:
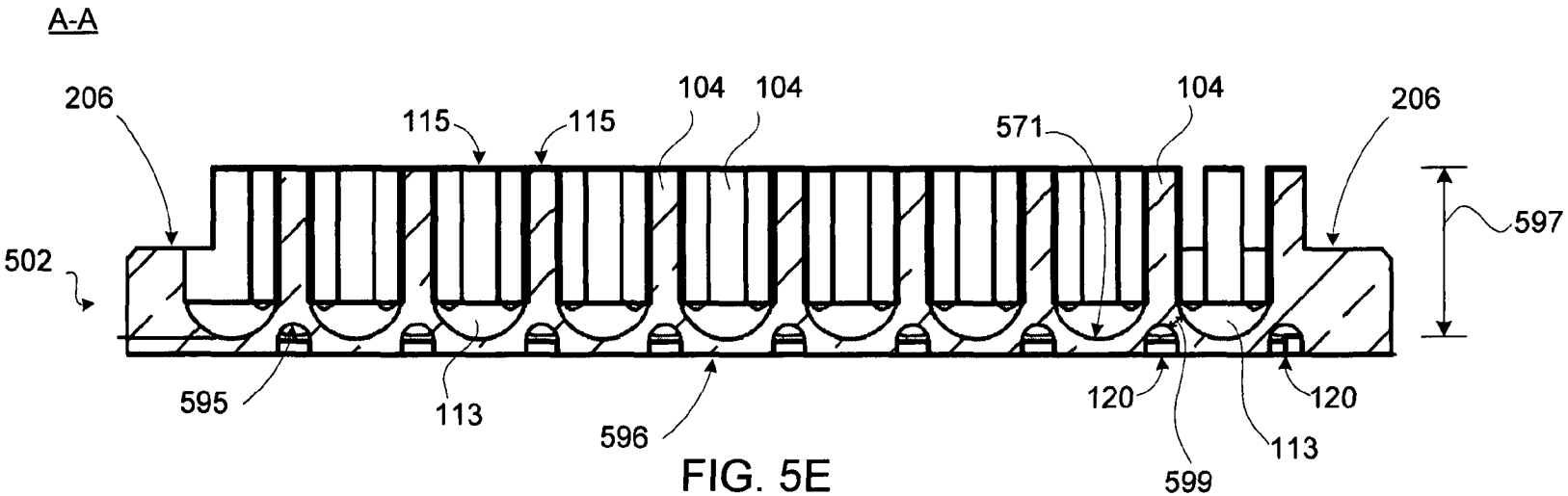
FIG. 5E is a cross-sectional view along cross-section axis A-A of the lower plate of FIG. 5A.

FIG. 5E is a cross-sectional view along cross-section axis A-A of lower plate 502 of FIG. 5A. In this example, distance from end 115 to a bottom of dimple 113, namely distance 597, is in a range of approximately 1.5 to 35.0 mm. As illustratively shown, some pins 104 may be generally vertically aligned with micro-channels 120. Further, as illustratively shown, dimples 113 may in some instances extend between micro-channels 120. Minimum distance 599 between an interior surface 571 associated with dimple 113 and interior surface 595 associated with micro-channel 120, namely minimum distance 599, may be approximately 0.2 to 3.5 mm. By having a relatively thin distance 599, heat transfer may be facilitated. Notably, a sealing plate may be coupled to underside surface 596 of lower plate 502.

Figure 5F:
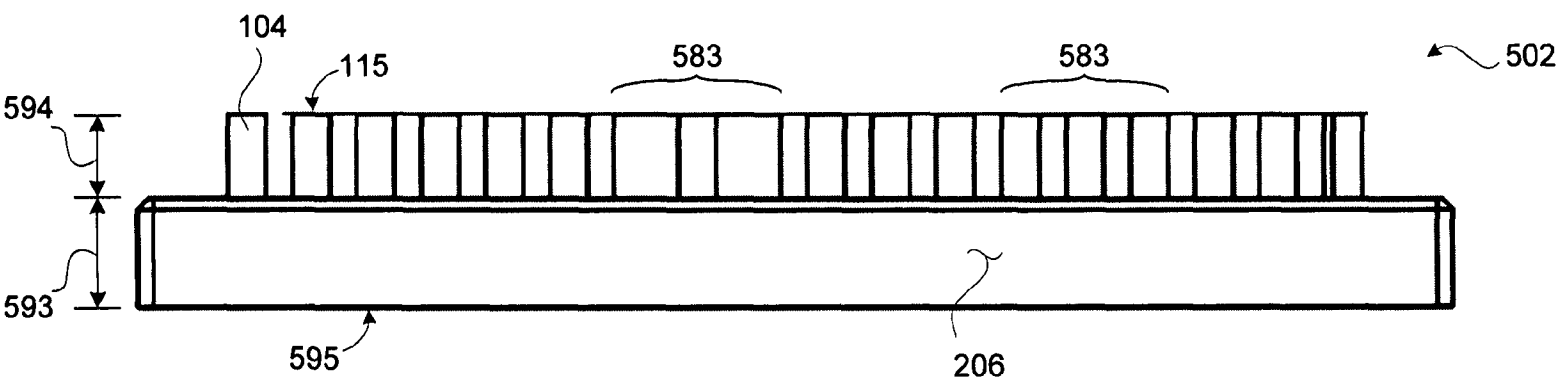
FIG. 5F is a side view from a side of a lower plate of FIG. 5A.

FIG. 5F is a side view from a side 566 of lower plate 502 of FIG. 5A. Pins 104 may extend above sidewall 206 for distance 594, which is approximately 1 to 34 mm in this example. In this example, sidewall 206 has a height 593 of approximately 0.5 to 12.0 mm. Additionally, side views of fluid flow dams 583 are illustratively shown.

Figure 5G:
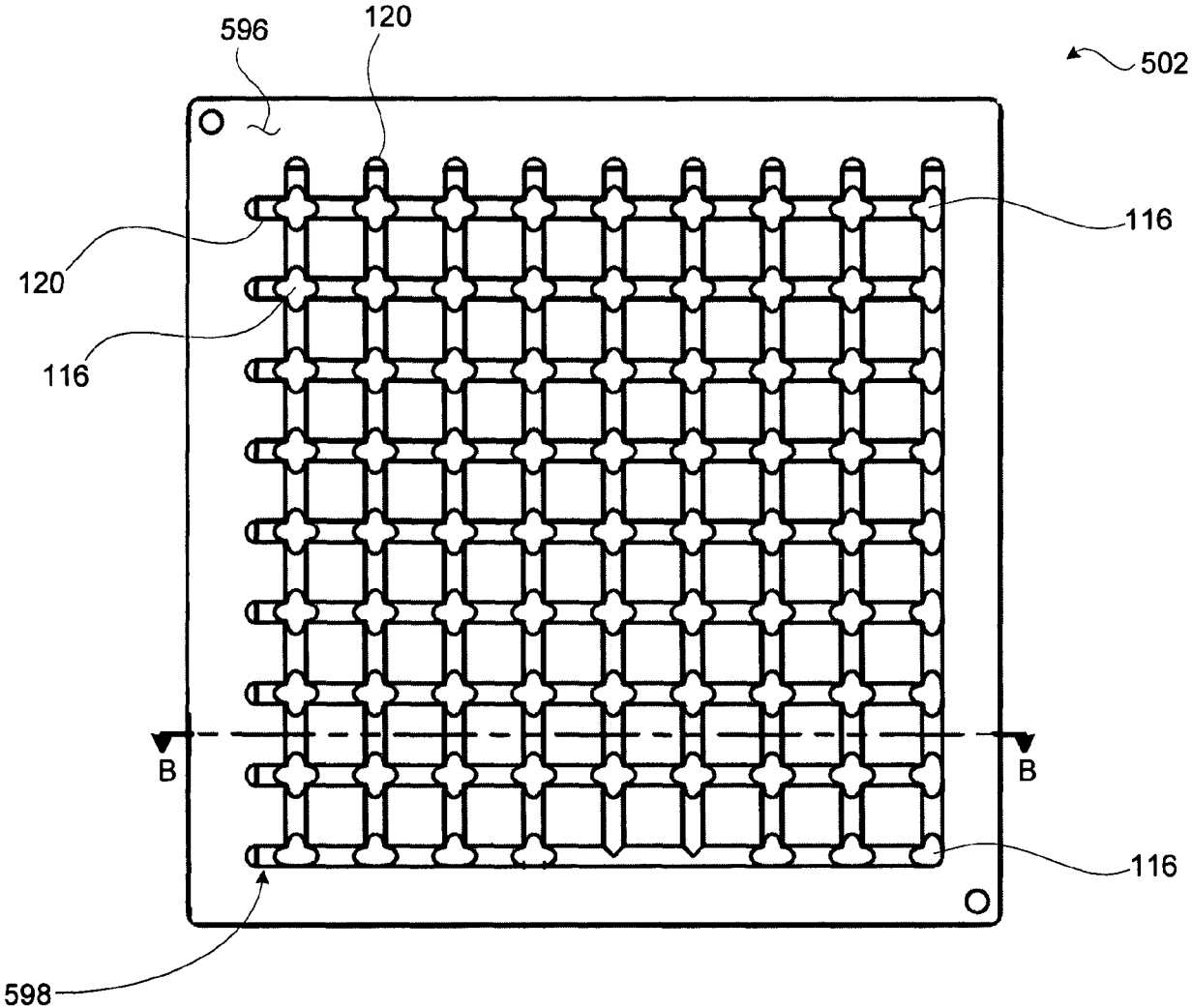
FIG. 5G is a bottom plan view depicting the lower plate of FIG. 5A

FIG. 5G is a bottom plan view depicting an underside surface of lower plate 502 of FIG. 5A. As illustratively shown, horizontally and vertically oriented micro-channels 120 intersect one another defining some of orifices 116 in combination with dimples 113, such as dimples 113 of FIG. 5A (not shown in FIG. 5G). Again, orifices 116 may take different shapes owing to the configuration of intersection of one or more micro-channels 120 with an associated dimple 113. However, even though an array of micro-channels 120 is illustratively shown as a network of micro-channels, it should be appreciated that micro-channels need not be placed in horizontal and vertical lines to form an array. To provide more uniform cooling, micro-channels may be oriented according to position of inlet and outlet. If the target block to have heat transferred from it has a non-uniform thermal gradient, micro-channels 120 may be arranged to accommodate such non-uniform thermal gradient, such as to provide a more uniform thermal gradient in combination with such target block.

Accordingly, by tailoring a network of micro-channels 120, namely "network of micro-channels 598," to a target device to be cooled, a heat transfer device, such as heat transfer device 100 of FIG. 1A, may, when in combination with a device to be cooled, have a substantially uniform thermal gradient in comparison to a substantially less uniform thermal gradient of such a device to be cooled without such a heat transfer device. In other words, even though the block or target object to be cooled may have a non-uniform thermal gradient, in operation, heat transfer device 100 with a network of micro-channels 598, with or without chambers in an interior region 130 as previously described with reference to FIGS. 1A and 5A, may be configured such that the target object to be cooled and heat transfer device 100 in combination have a substantially uniform thermal gradient.

Figure 5H:
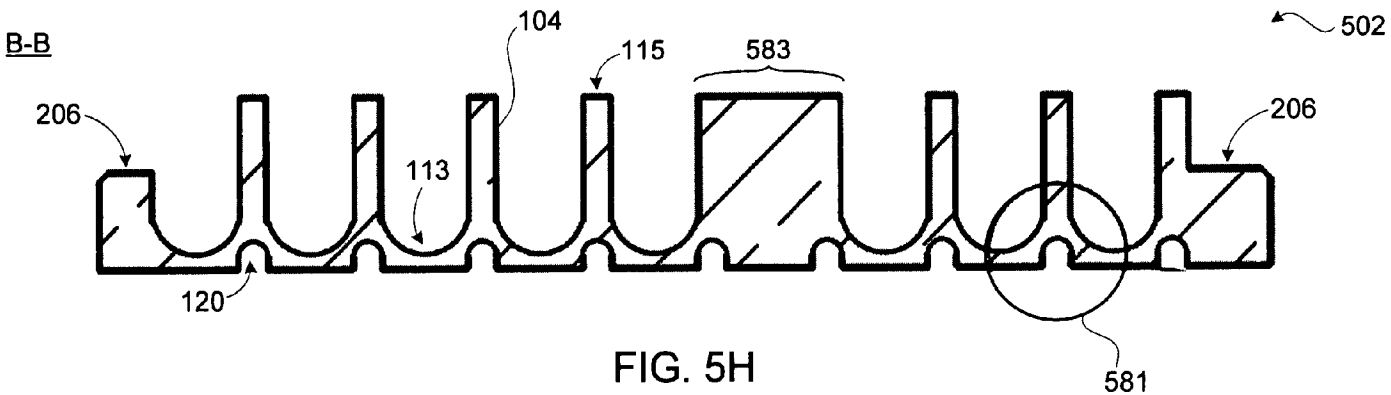
FIG. 5H is a cross-sectional view along cross-section axis B-B of the lower plate of FIG. 5G.

FIG. 5H is a cross-sectional view along cross-section axis B-B of lower plate 502 of FIG. 5G. Again, it should be appreciated that micro-channels 120 may be generally vertically aligned with pins 104. In this particular example, micro-channels 120 are formed with semicircular dimple tops and generally vertical sidewalls. When a sealing plate (not shown in FIG. 5H) is added to form floors associated with channel passageways, such channel passageways resemble tunnels with arched upper entries.

Figure 5I:
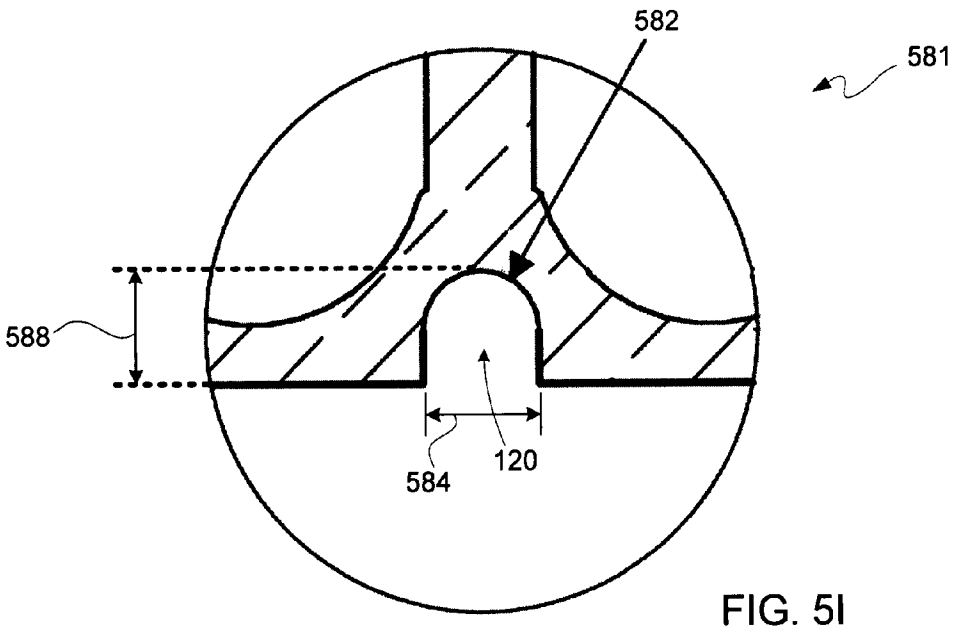
FIG. 5I is an enlarged view of an area of FIG. 5H.

FIG. 5I is an enlarged view of area 581 of FIG. 5H. In this example, micro-channel 120 has a radius of curvature 582 in a range of approximately 0.2 to 3.5 mm, an overall height 588 of approximately 0.2 to 5.5 mm, and a width 584 of approximately 0.2 to 3.5 mm. However, even though tunnel-like channel passageways are illustratively shown, it should be appreciated that other forms of micro-channels may be used. For example, micro-channel passageways may be circular, rectangular, square, hexagonal, trapezoidal, triangular, or elliptical.

Figure 5J:
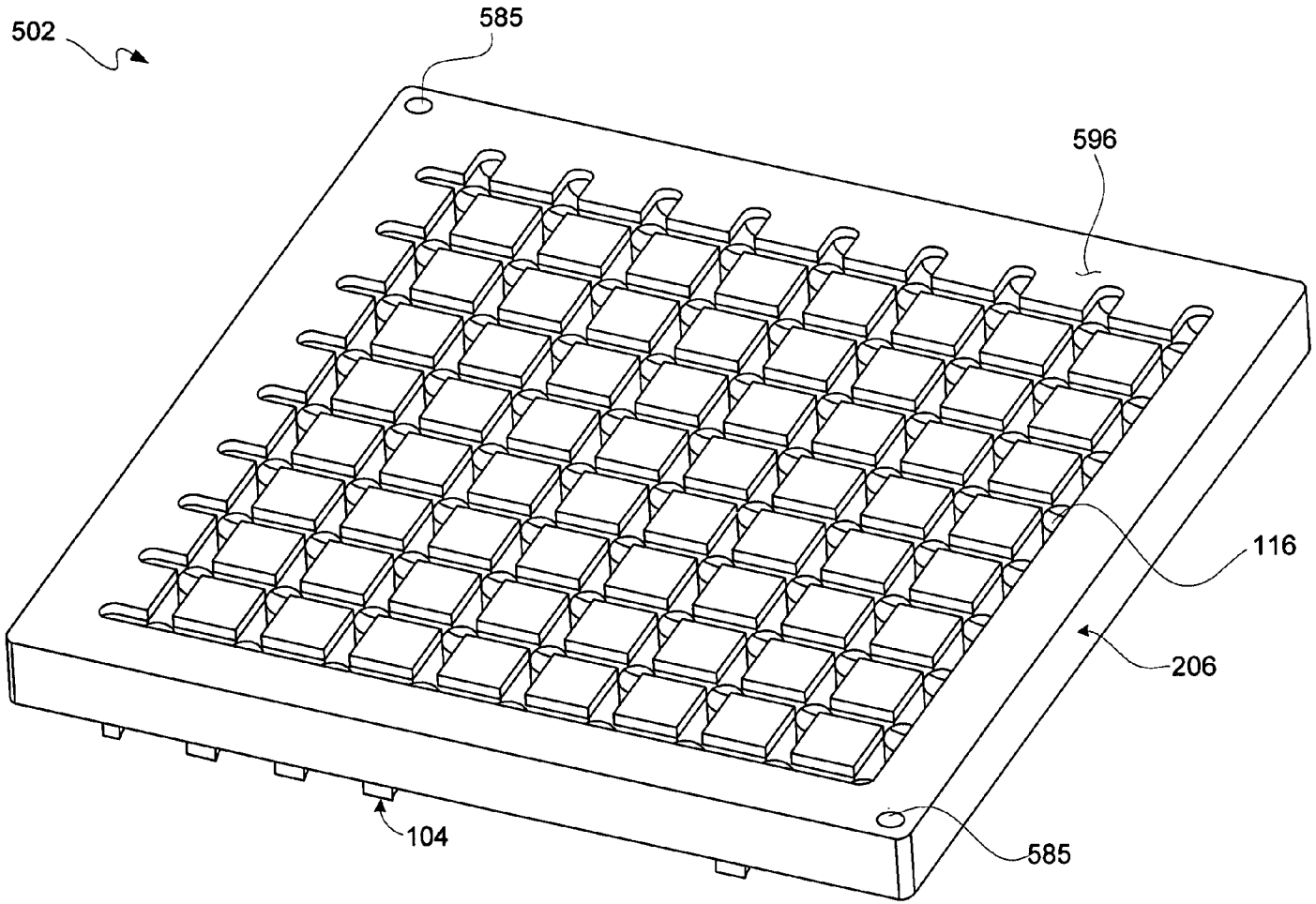
FIG. 5J is a perspective view depicting an underside of the lower plate of FIGS. 5A and 5G.

FIG. 5J is a perspective view depicting an underside of lower plate 502. Notably, holes 585 may be for coupling one or more other plates to lower plate 502.

Figure 5K:
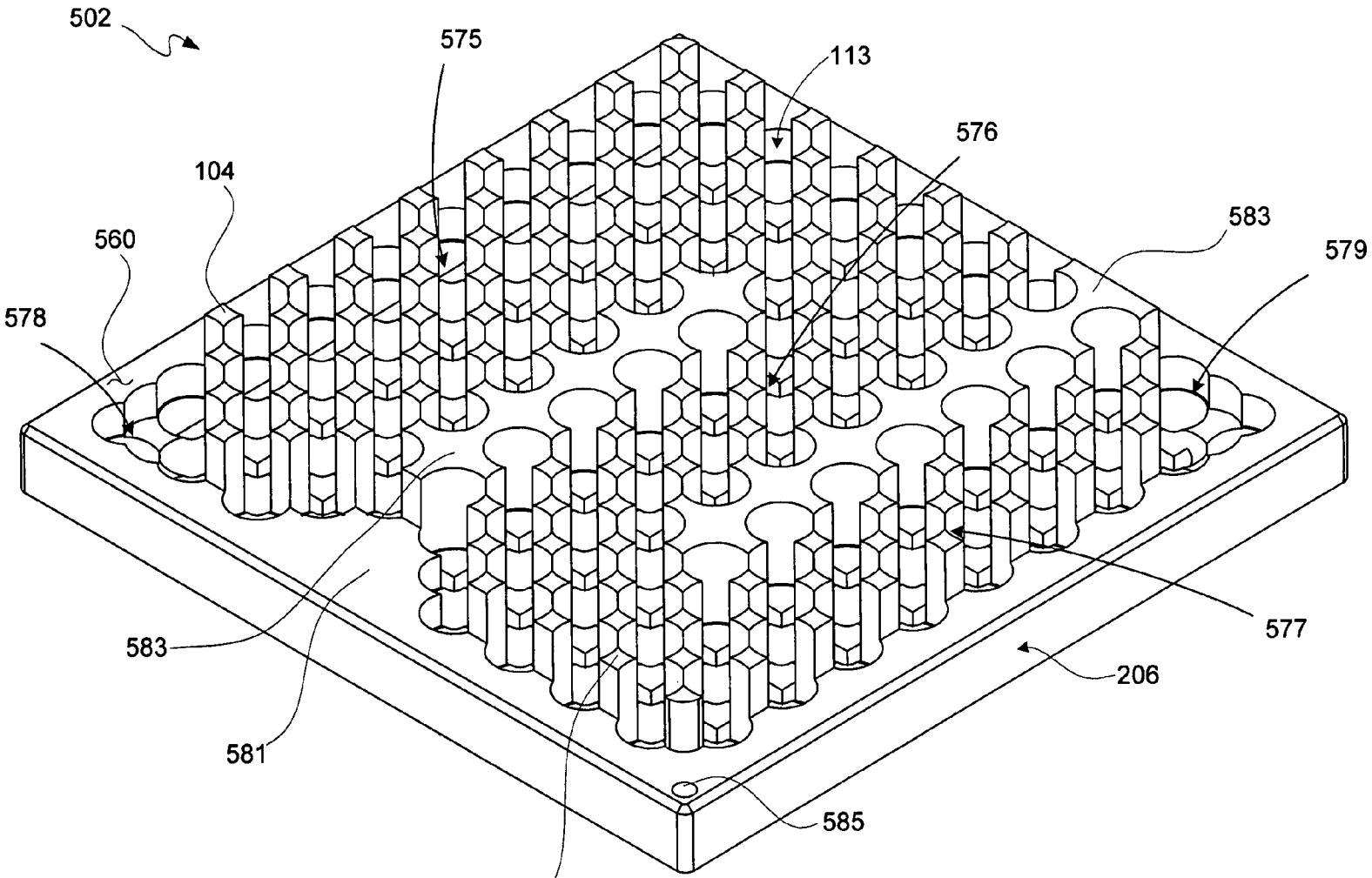
FIG. 5K is a perspective view depicting an upper side of the lower plate of FIGS. 5A and 5G.

FIG. 5K is a perspective view depicting an upper side of lower plate 502. Notably, peninsula 581 is lower in elevation that fluid flow dam 583, and thus to prevent fluid flow across peninsula 581, a counterpart of peninsula 581 in an upper plate may be used for chambering fluid flow in an interior region.

It should be appreciated that hydraulic resistance may be adjusted by chambering an interior volume with fluid flow dams. For example, suppose an inlet is defined by an upper surface of an upper plate and positioned proximal to a corner thereof, with an outlet being on a diagonally opposite corner. In this configuration, fluid may first flow into a first chamber 575 generally entering at location 578. Such fluid may then flow into a second chamber 576, and then into a third chamber 577 and exit the third chamber generally at a location 579.

Because chamber 575 has more pins than chambers 576 and 577, it is capable of transferring more heat than chambers 576 and 577. However, because chamber 575 is wider than chambers 576 and 577, fluid flow velocity may be less in chamber 575 than in chambers 576 and 577. It should be further understood that fluid temperature may be lower when entering chamber 575 than when exiting chamber 577, and may progressively increase until exiting chamber 577. Fluid flow velocity increases in chamber 576 over fluid flow velocity in chamber 575, as chamber 576 is narrower than chamber 575. Furthermore, fluid flow velocity increases in chamber 577 over fluid flow velocity in chamber 576, as chamber 577 is narrower than chamber 576. A more rapid fluid flow facilitates heat transfer. Thus, chambering fluid flow out, such to provide a serpentine flow as indicated by arrow 500 of FIG. 5A as opposed to a more direct flow from inlet to outlet, may be used to adjust hydraulic resistance. Moreover, micro-channel diameter may correspondingly be made wider or narrower depending on targeted fluid flow rates in areas. Adjusting fluid flow by chambering or micro-channel diameter or both may be used to address thermal variation of a high heat flux block, or may be to provide a single heat transfer device that may be used for a variety of applications.

Figure 6A:
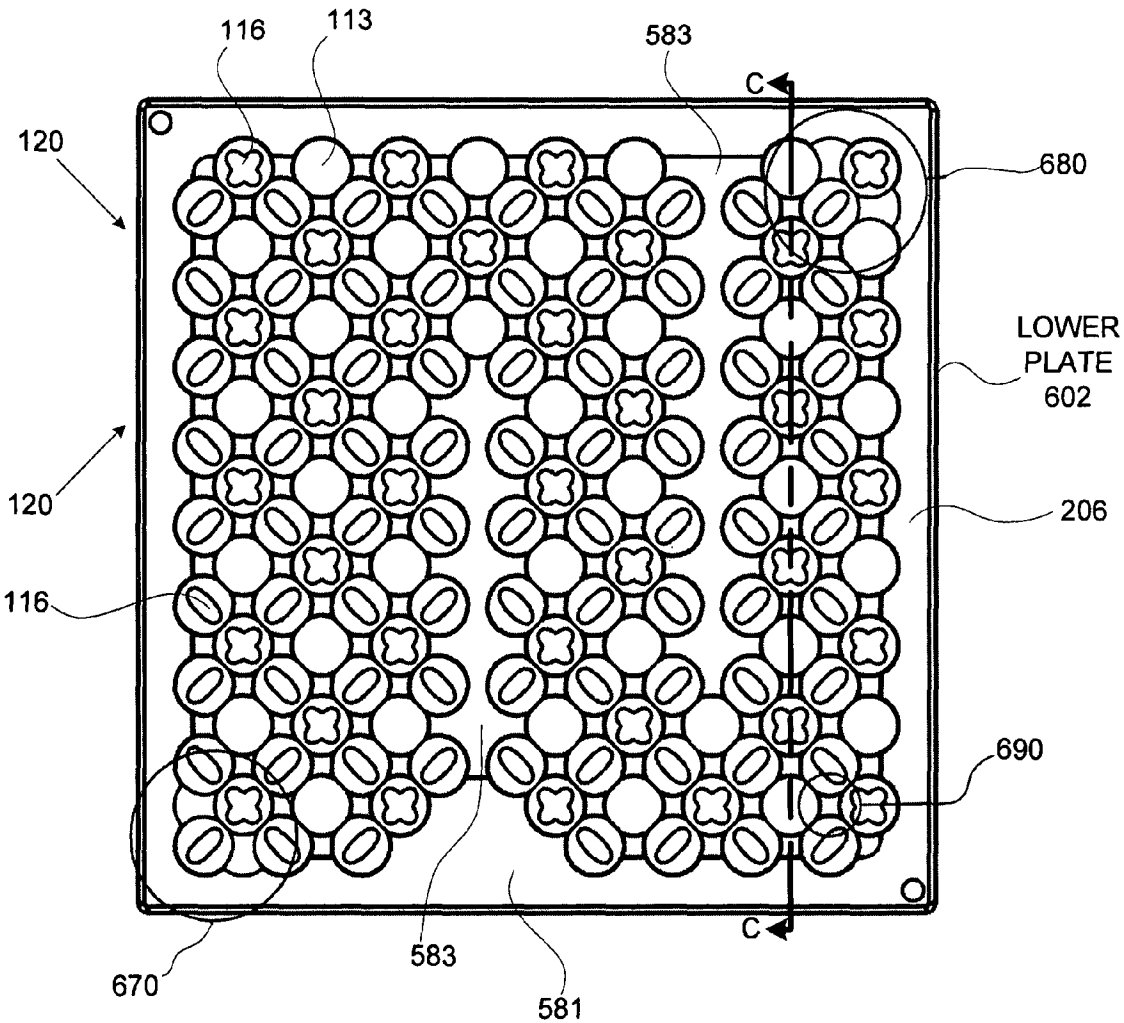
FIG. 6A is a top plan view depicting an alternative exemplary embodiment of a lower plate of a heat transfer device.

FIG. 6A is a top plan view depicting an exemplary embodiment of a lower plate 602. Lower plate 602 is similar to lower plate 502 of FIG. 5A, and thus likewise may be implemented as part of a heat transfer device, such as previously described with reference for example to FIG. 2B. Lower plate 602, being similar to lower plate 502 of FIG. 5A, has similar description, and thus such common description is not repeated. Moreover, as an upper plate asymmetrical counterpart to lower plate 502 may be understood from the prior description and the following additional description of lower plate 602, repetitious description of an upper plate is avoided for purposes of clarity.

Lower plate 602 differs at least in part from lower plate 502 of FIG. 5A by having diagonally oriented micro-channels 120. Thus, diagonally oriented micro-channels 120 intersect dimples 113 at different orientations than the generally orthogonally oriented micro-channels illustratively shown in FIG. 5A. Dimples 113 partially overlap with micro-channels 120 in a vertical direction such that when both have been formed, orifices may result oriented responsive to orientation of the one or more micro-channels with which such orifices are associated. These orientations are described in additional detail with reference to the enlarged views of FIGS. 6B, 6C, and 6D.

Figure 6C:
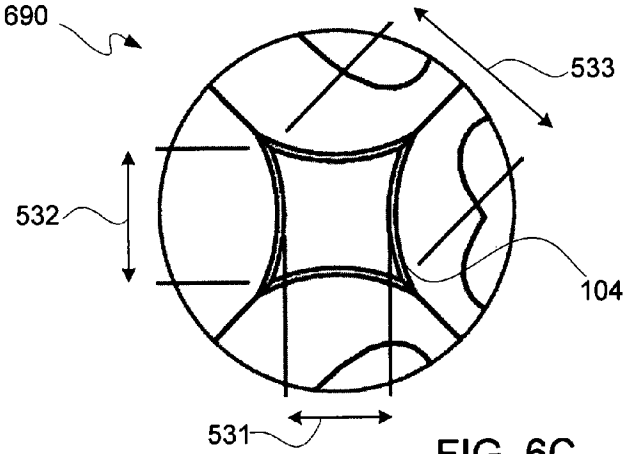
FIG. 6C is an enlarged view of another area of FIG. 6A.
Figure 6B:
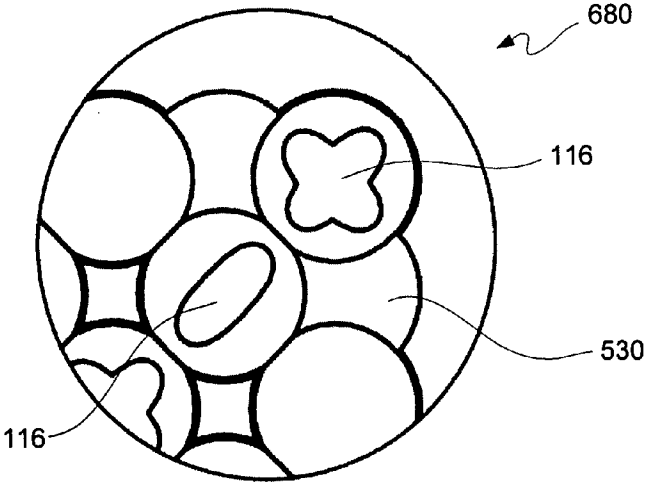
FIG. 6B is an enlarged view of an area of FIG. 6A.
Figure 6D:
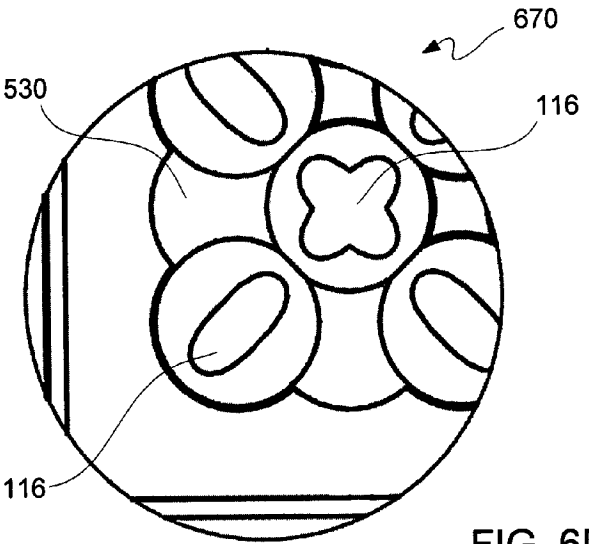
FIG. 6D is an enlarged view of yet another area of FIG. 6A.

FIG. 6B is an enlarged view of area 680 of FIG. 6A. FIG. 6C is an enlarged view of area 690 of FIG. 6A. FIG. 6D is an enlarged view of area 670 of FIG. 6A. With simultaneous reference to FIGS. 6A through 6D, lower plate 602 is further described.

In contrast to the generally horizontally and vertically aligned cross-like orifices 116 of FIG. 5A, some orifices 116 of FIG. 6A, namely those orifices 116 associated with the intersection of two diagonally oriented micro-channels 120, may have an "X"-like form, namely with diagonally disposed openings which intersect to form a single orifice 116. Additionally, for dimples 113 associated with a single micro-channel 120, as opposed to two intersecting micro-channels 120 associated with the X-like orifice 116, an oblong orifice 116 is formed by the formation of micro-channels and dimples. The orientation of oblong orifices 116 will generally depend on the orientation of the micro-channel with which they are associated. Notably, pins 104 of FIG. 6C may be the same as pins 104 of FIG. 5C for example.

Figure 6E:
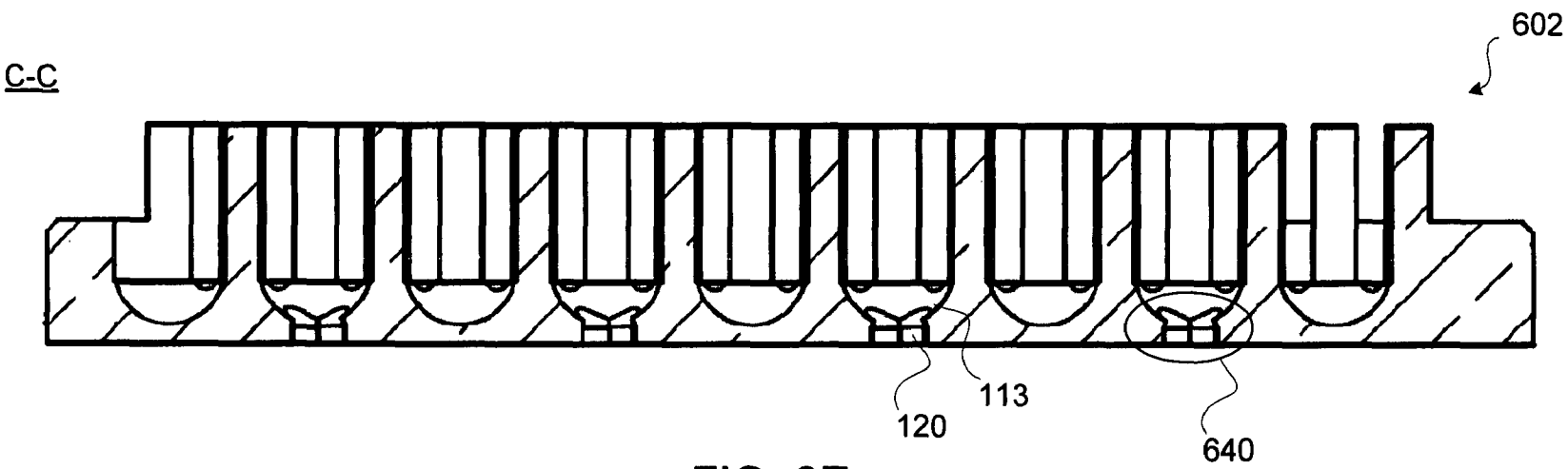
FIG. 6E is a cross-sectional view along cross-section axis C-C of the lower plate of FIG. 6A.

FIG. 6E is a cross-sectional view along cross-section axis C-C of lower plate 602 of FIG. 6A. Notably, the cross-sectional view of FIG. 6E is the same as that of FIG. 5E, except that the different orientation of micro-channels 120 is depicted as illustratively shown for example in area 640. In this cross-sectional view, the intersection of micro-channels 120 and dimples 113 is illustratively shown, where micro-channels 120 are generally positioned directly under dimples 113. Notably, the side view of lower plate 602 of FIG. 6A is the same as the side view of lower plate 502 of FIG. 5A, as illustratively depicted in FIG. 5F, and thus is not repeated.

Figure 6F:
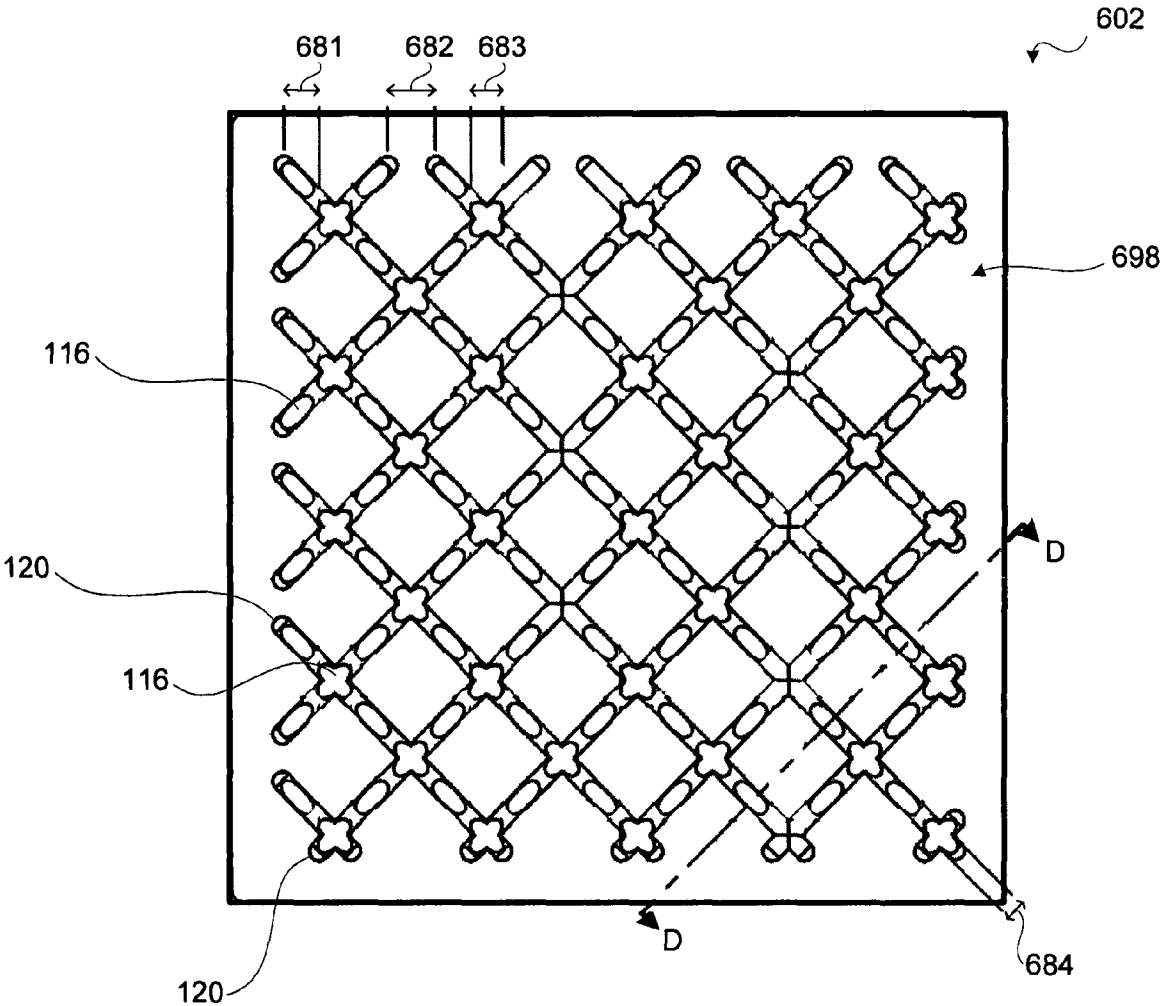
FIG. 6F is a bottom plan view depicting the lower plate of FIG. 6A.

FIG. 6F is a bottom plan view depicting an underside of lower plate 602 of FIG. 6A. As illustratively shown, diagonally oriented micro-channels 120 intersect each other. Additionally, formation of micro-channels 120 vertically overlap with formation of dimples 113 resulting in orifices 116. Other orifices 116 may result by the formation of a single diagonally oriented micro-channel 120 and an associated dimple 113. Again, orifices 116 may take any of a variety of shapes owing the configuration of intersection of one or more micro-channels 120 with an associated dimple 113. It should be appreciated that micro-channels 120 may be configured as a network of micro-channels 698.

Network of micro-channels 698 may be oriented to provide more uniform cooling across a surface. Accordingly, micro-channels 120 may be positioned relative to an inlet and an outlet for ingress and egress of fluid. In this example embodiment, horizontal distance 681 from end to end of an oblong orifice 116 is in a range of approximately 0.2 to 5.5 mm. Horizontal distance 682 from nearest ends of neighboring oblong orifices 116 is in a range of approximately 0.2 to 4.5 mm. Horizontal, as well as vertical, distance 683 of an X-like orifice 116 is in a range of approximately 0.2 to 4.5 mm. Lastly, distance 684, namely micro-channel width of a micro-channel 120, is in a range of approximately 0.2 to 5.5 mm.

Figure 6G:
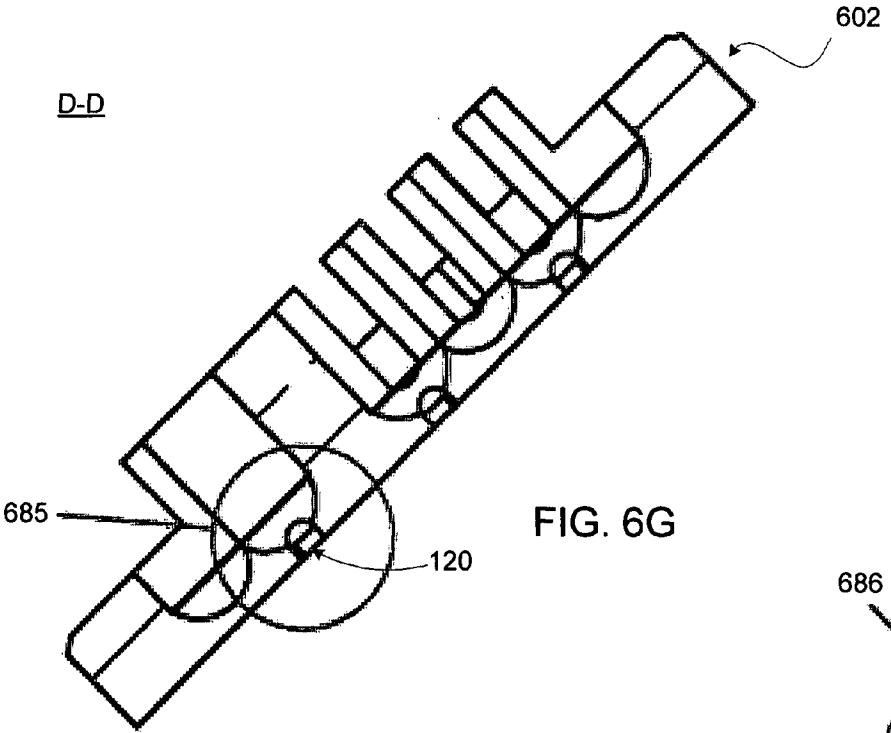
FIG. 6G is a cross-sectional view along cross-section axis D-D of the lower plate of FIG. 6F.
Figure 6H:
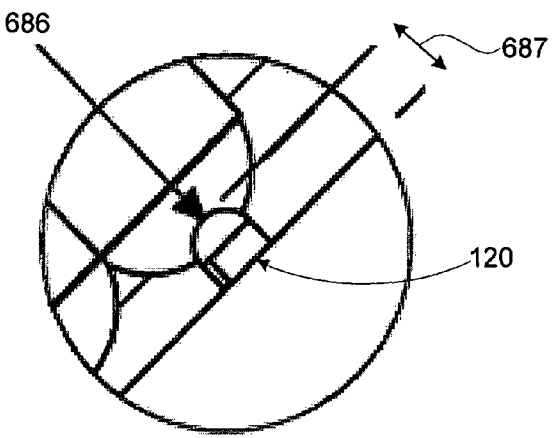
FIG. 6H is an enlarged view of an area of FIG. 6G.

FIG. 6G is a cross-sectional view along cross-section axis D-D of lower plate 602 of FIG. 6F. FIG. 6H is an enlarged view of area 685 of FIG. 6G. With simultaneous reference to FIGS. 6G and 6H, micro-channels 120 are further described. Each micro-channel 120 may have a radius of curvature in a range of approximately 0.1 to 4.0 mm, namely radius 686. Additionally, micro-channels 120 may have a depth 687 in a range of approximately 0.2 to 3.5 mm.

Figure 6I:
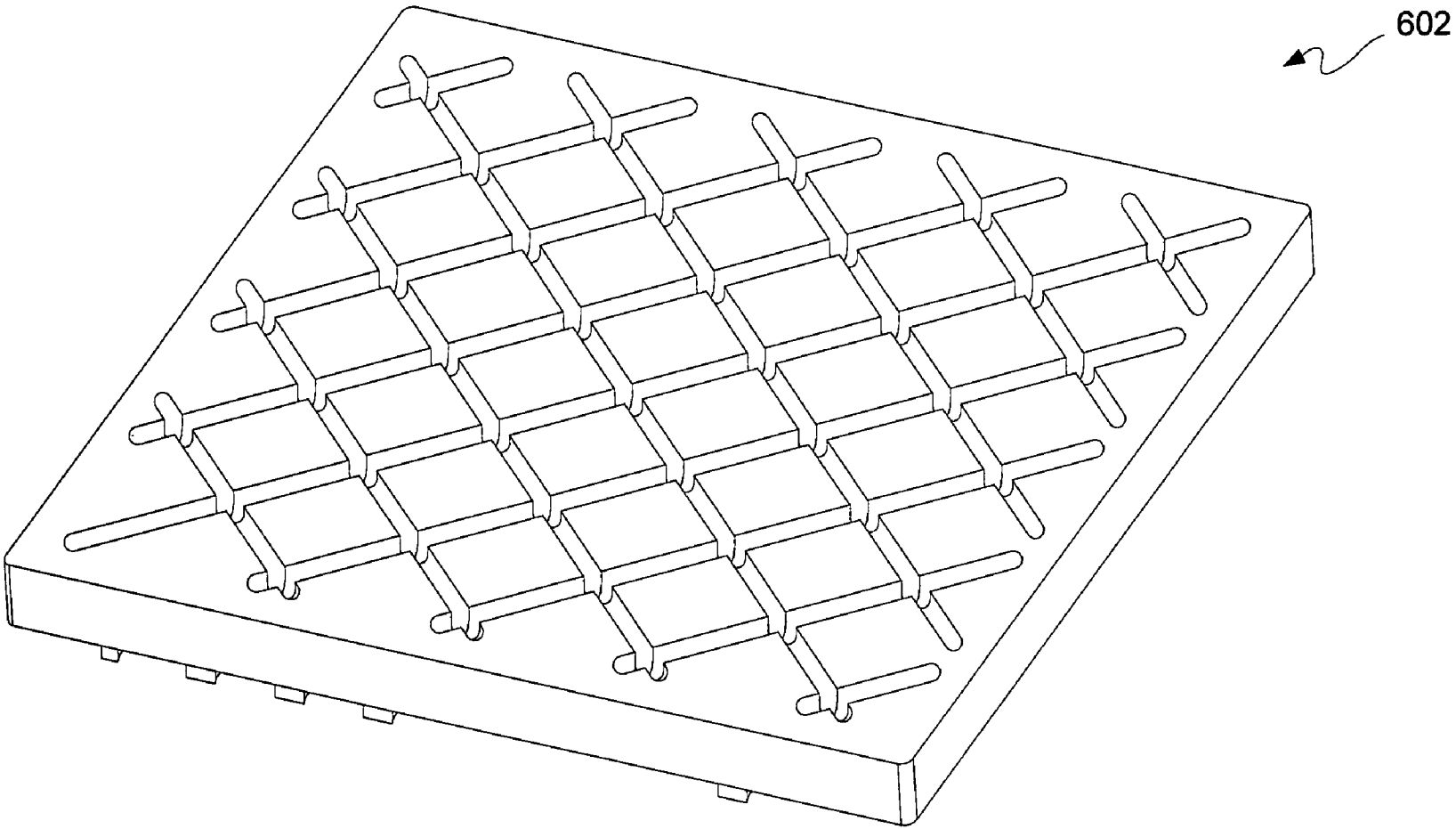
FIG. 6I is a perspective view depicting an underside of the lower plate of FIG. 6A.

FIG. 6I is a perspective view depicting an underside of lower plate 602. Notably, although uniformly spaced micro-channels 120 are illustratively shown with reference to FIG. 6I, as well as FIG. 5J, it should be appreciated that micro-channels 120 do not have to be uniformly spaced apart, and thus micro-channel spacing may vary from application to application in order to effect, for example, a more uniform temperature gradient across a surface. In other words, a network of micro-channels may be tailored to the thermal gradient of a surface of a high heat flux block, which may involve variations in one or more of spacing between micro-channels, depth of micro-channels, the number of micro-channels, the location of micro-channels, hydraulic diameter of micro-channels, or width of micro-channels. For example, microprocessors may dissipate most of their wattage within an area of substantially less than half their surface area, and thus a network of micro-channels may be tailored to such an application.

Figure 6J:
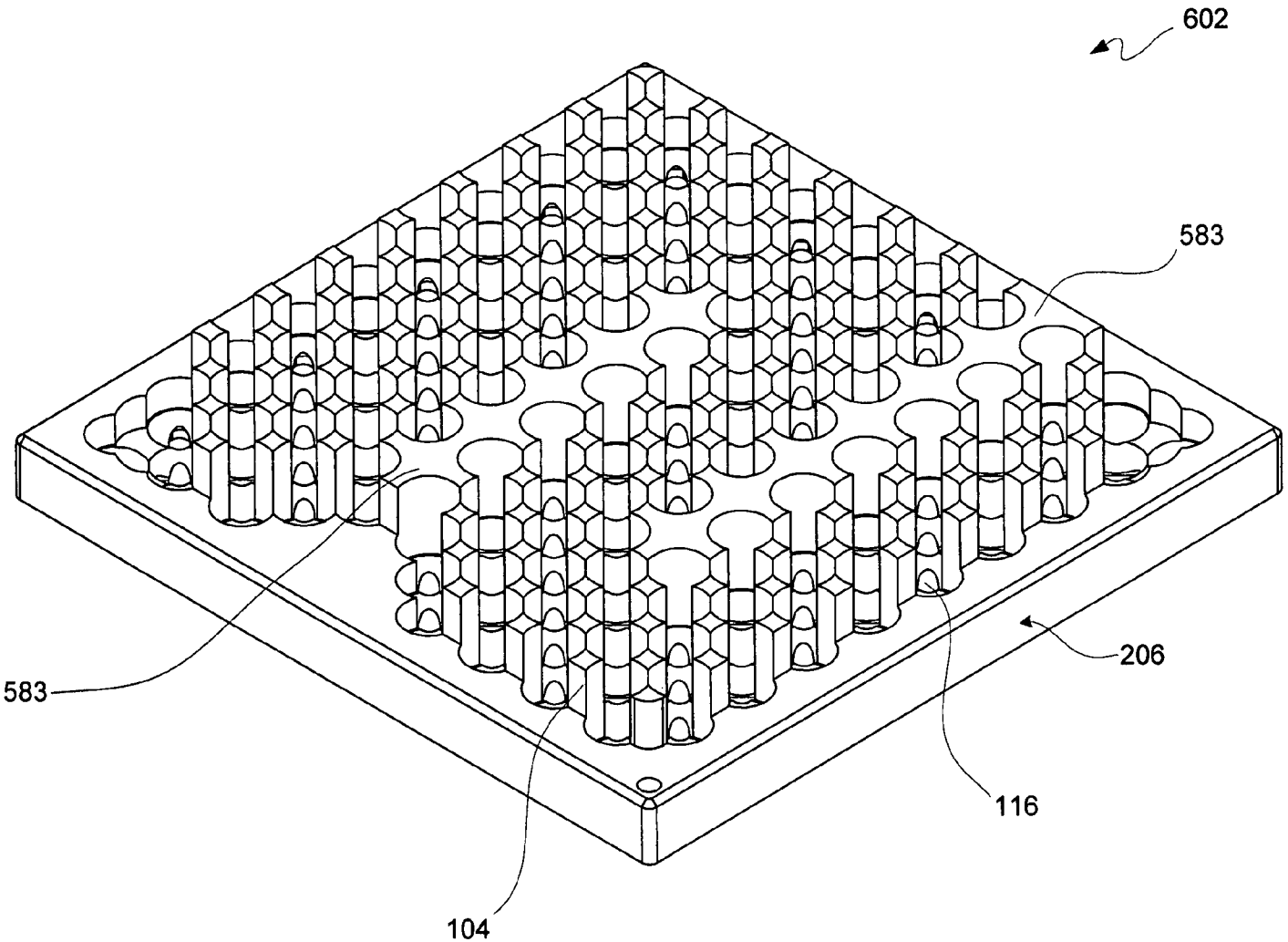
FIG. 6J is a perspective view depicting an upper side of the lower plate of FIG. 6A.

FIG. 6J is a perspective view depicting an upper side of lower plate 602. Again, fluid flow dams 583, if used, may be located as determined for an application. Notably, micro-channel orientation may be tailored to location of one or more inlets and one or more outlets. Thus, for example, alignment of diagonal micro-channels may be for an inlet and an outlet disposed at diagonally opposite corners of a heat transfer device. In this example, fluid flow may be generally parallel with one of the two orientations of diagonal micro-channels by locating an inlet and an outlet at diagonally opposite corners of a top plate of a heat transfer device.

Figure 7A:
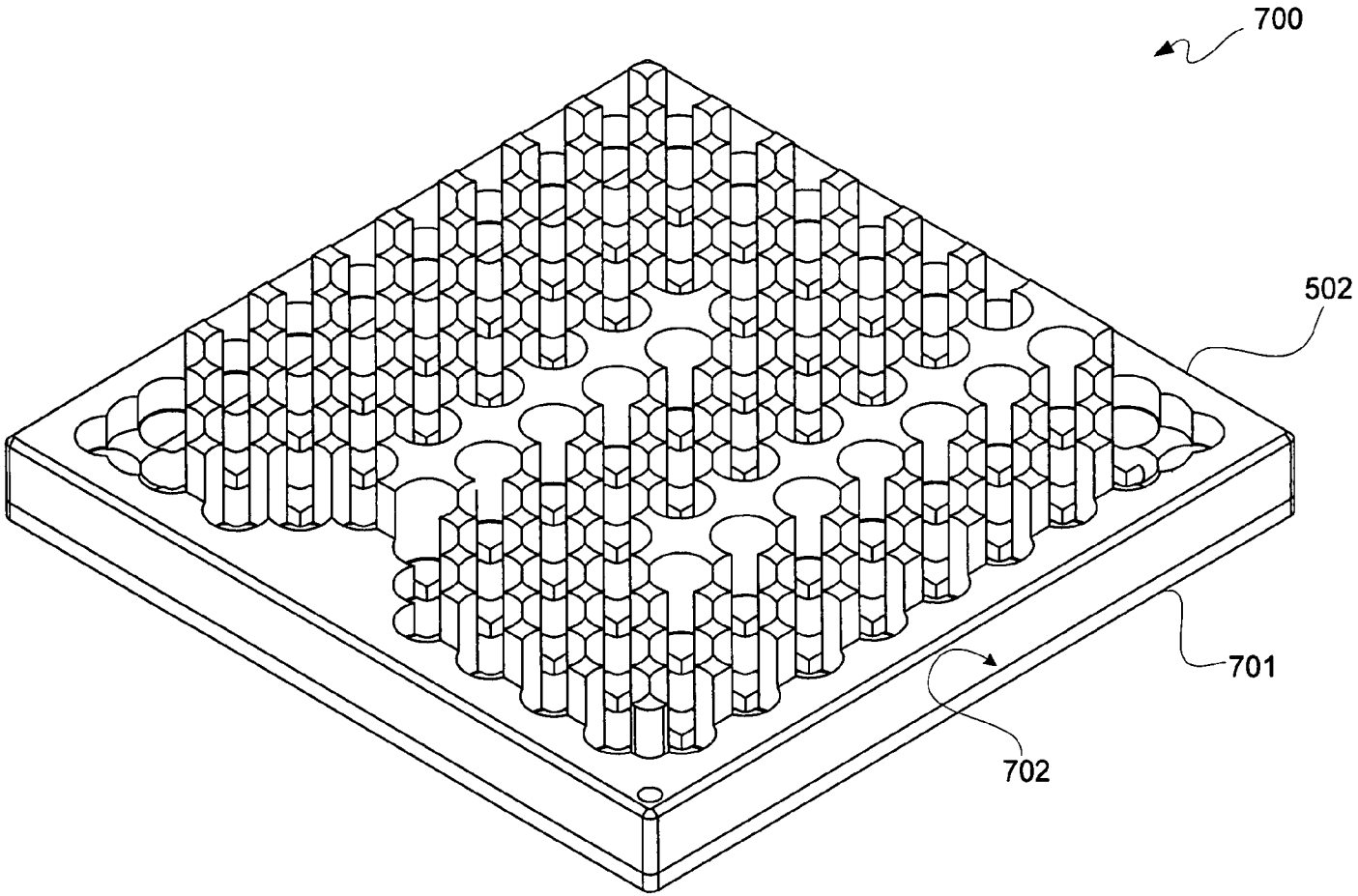
FIG. 7A is a perspective view depicting a lower portion assembly of a heat transfer device including an upper side of the lower plate of FIG. 5A coupled to a sealing plate.

FIG. 7A is a perspective view depicting an exemplary embodiment of a lower portion of a heat transfer assembly 700. A heat transfer device such as has been described herein generally may be used in heat transfer assembly 700. Lower portion of assembly 700 includes an upper side of lower plate 502 coupled to a sealing plate 701. For sealing plate 701 and lower plate 502 being coupled via soldering, such as for example when both lower plate 502 and sealing plate 701 are made of copper, sealing plate 701 may initially be substantially larger than illustratively shown in FIG. 7A. A larger mass may provide for more uniform heat for flow of solder to provide solder joint 702 such that it does not substantially intrude into micro-channels 120 of FIG. 1A. Furthermore, a foil sheet of solder may be used. Alternatively, silver, gold, tin, or other material may be used to provide this coupling.

Excess material associated with sealing plate 701 may be removed after soldering to lower plate 502. It should be appreciated that by having a thin sealing plate 701, heat conduction, and thus heat transfer, may be facilitated for removal of heat from a high heat flux block. Thus, lower portion of assembly 700 of a heat transfer device 100 of FIG. 1A may be coupled to an interposed upper portion, as previously described, for forming a heat transfer device.

Figure 7B:
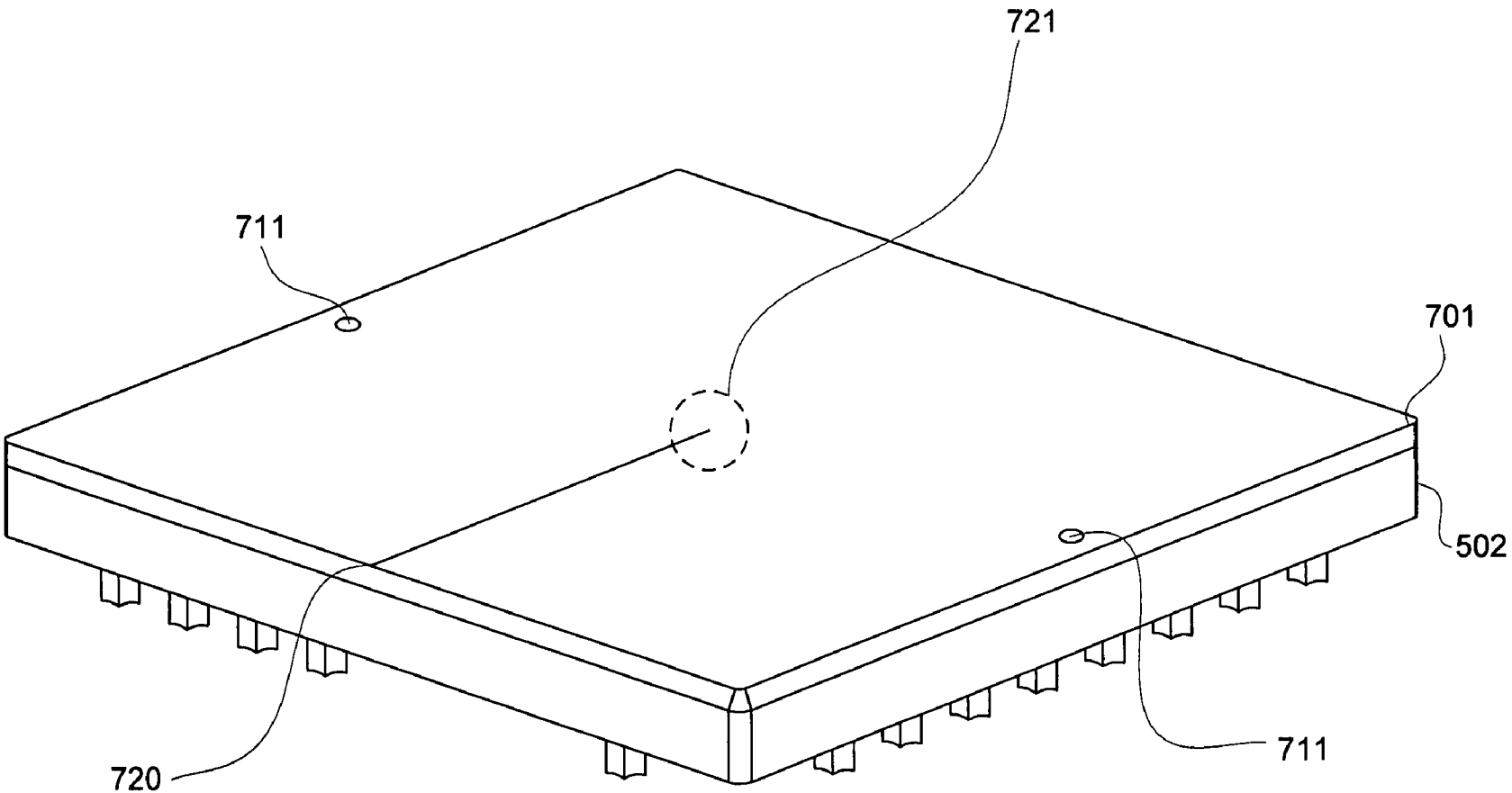
FIG. 7B is a perspective view depicting an underside of the lower portion assembly of FIG. 7A.

FIG. 7B is a perspective view depicting an underside of the lower portion of assembly 700 of FIG. 7A. Holes 711 may be drilled and tapped for additional coupling of sealing plate 701 to lower plate 502. Additionally, a channel 720 may be milled or otherwise formed extending to a middle area 721 of sealing plate 701. Channel 720 may be for receiving a thermocouple.

It should be appreciated that a heat transfer device has been described where heat associated with a high-heat flux device may be transported away using a fluid as a thermal energy carrier. Notably, the degree of hydrodynamic losses associated with such heat transfer device is sufficiently low, such that complexity associated with pumping fluid is reduced. Furthermore, this reduction in hydrodynamic losses facilitates using less powerful pumps. Additional information regarding hydrodynamic losses may be found in M. Spokoiny et al., "Enhanced Heat Transfer in a Channel with Combined Structure of Pin and Dimples", Proceedings of $9^{th}$ AIAA/ASME Joint Thermophysics and Heat Transfer Conference, 5-8 June (2006), San Francisco, Calif.

As previously indicated, numerical examples associated with a heat transfer device for an integrated circuit, and in particular a microprocessor, have been described. However, it should be understood that a heat transfer device may be decreased or increased in size to accommodate applications smaller or larger than an integrated circuit. So although specific numerical examples of dimensions have been provided, other dimensions may be used, as well as other known geometric shapes, other than those specifically described herein. Thus, in general, the following ratios may be used: the ratio of the cross-sectional area of a micro-channel to the cross-sectional area of a main channel may be in a range of approximately $5\times10^{-6}$ to $2\times10^{-1}$; the ratio of the depth of a dimple to the diameter of a dimple may be in a range of approximately 0.1 to 0.5; the ratio of the diameter of a dimple to the hydraulic diameter of a micro-channel may be in a range of approximately 0.1 to 50.0; the ratio of the distance from the end surface of a pin to surface of a dimple, for example distance 105 in FIG. 1A, to diameter of a dimple may be in a range of approximately $5\times10^{-2}$ to 6; the ratio of orifice diameter, for example width 584 in FIG. 5I, to dimple diameter may be in a range of approximately 0.1 to 0.7; and the ratio of orifice depth, for example height 588 in FIG. 5I, to dimple diameter may be in a range of approximately −0.5 to 3.0. Notably, a negative value is used to indicate that a micro-channel may be located either below the bottom of a dimple, which is referred to as positive depth, or above the bottom, or at least projected bottom, of a dimple, which is referred to as negative depth. In this example, the bottom of a dimple refers to the lowest point of the dimple, or the projected lowest point of the dimple. An example of this lowest point is where the end point of arrow 113 shown in FIG. 5H is pointing to.

While the foregoing describes exemplary embodiment(s) in accordance with one or more aspects of the invention, other and further embodiment(s) in accordance with the one or more aspects of the invention may be devised without departing from the scope thereof, which is determined by the claim (s) that follow and equivalents thereof. For example, known materials other than those specifically listed herein may be used.

Claim(s) listing steps do not imply any order of the steps. Trademarks are the property of their respective owners.

What is claimed is:

1. A heat transfer device, comprising:

a chambered heat exchanger having interior surfaces defining an interior volume, the chambered heat exchanger having an inlet and an outlet for passage of liquid into and out of the interior volume;

the chambered heat exchanger including:

first pins extending from a first interior surface of the interior surfaces;

first contours of a second interior surface of the interior surfaces being spaced apart from and at least substantially aligned with ends of the first pins;

a portion of the first contours having first orifices extending from the second interior surface through to a third interior surface of the interior surfaces; and the third interior surface having a network of micro-channels intersecting the orifices, the network of micro-channels having micro-channel passages;

wherein the first contours are dimples;

wherein the chambered heat exchanger further includes:

second pins extending from the second interior surface;

second contours of the first interior surface being spaced apart from and at least substantially aligned with ends of the second pins; and the first pins and the second pins spaced apart from one another and overlapping one another with reference to vertical orientation thereof.

2. The heat transfer device, according to claim 1, wherein the chambered heat exchanger further includes:

the micro-channel passages being a first portion of the interior volume;

the first interior surface and the second interior surface in part defining a second portion of the interior volume; and the orifices of the second interior surface and the third interior surface for passage of the liquid between the first portion and the second portion of the interior volume.

3. The heat transfer device, according to claim 2, wherein the inlet and the outlet of the chambered heat exchanger extend to the second portion of the interior volume.

4. The heat transfer device, according to claim 2, wherein the second contours are dimples.

5. The heat transfer device, according to claim 2, wherein the hydraulic diameter of the micro-channel passages is in a range of approximately 0.2 mm to 3.5 mm.

6. The heat transfer device, according to claim 5, wherein the micro-channel passages have a channel length in a range of approximately 4 mm to 30 mm.

7. The heat transfer device according to claim 1, wherein the heat transfer device has a laminar to turbulent flow transition for a Reynolds number in a range of approximately 1100 to 1700.

8. The heat transfer device according to claim 1, wherein the heat transfer device is configured at least in part for turbulent flow of the liquid therein and has a maximum rate of heat transport in wattage dissipation per unit area of approximately 100 watts per $cm^2$ for the turbulent flow of the liquid.

9. The heat transfer device according to claim 8, wherein the heat transfer device is capable of providing a temperature difference of approximately 50 degrees Celsius with reference to a target object to be cooled which dissipates heat at the maximum rate of heat transport.

10. The heat transfer device according to claim 1, wherein the heat transfer device is configured at least in part for boiling flow of the liquid therein and has a maximum rate of heat transport in wattage dissipation per unit area of approximately 1000 watts per $cm^2$ for the boiling flow of the liquid.

11. A heat transfer device, comprising:

a housing having input and output ports for ingress and egress of a medium;

the housing defining an interior volume;

a first portion of the interior volume having pins extending therein;

a second portion of the interior volume defined in part by a network of micro-channels;

an interface between the first portion of the interior volume and the second portion of the interior volume having orifices for providing passageways for flow of the medium between the first portion and the second portion;

a first portion of the pins spaced apart from the interface to promote generation of vortices of the medium in the first portion of the interior volume;

the first portion of the pins extending from a first interior surface of the housing defining in part the interior volume;

a second portion of the pins extending from a second interior surface of the housing defining in part the interior volume and associated with the interface; and the network of micro-channels intersecting first dimples defined by the second interior surface at locations respectively associated with the orifices.

12. The heat transfer device according to claim 11, further comprising:

the network of micro-channels having micro-channel passages with a hydraulic diameter;

the first portion of the pins and the second portion of the pins spaced apart and vertically overlapping;

ends of the first portion of the pins substantially vertically aligned with the orifices; and ends of the second portion of the pins substantially vertically aligned with second dimples defined by the first interior surface.

13. The heat transfer device according to claim 12, wherein the micro-channel passages have a hydraulic diameter of approximately 0.2 to 3.5 mm; wherein the first and second dimples have a diameter in a range of approximately 0.5 to 5.0 mm and have a depth in a range of approximately 0.25 to 2.5 mm; wherein the first and second dimples are spaced apart by approximately 0.2 to 10.0 mm on center; wherein the orifices have a diameter in a range of approximately 0.2 to 5.0 mm; wherein the pins have a height in a range of approximately 0.8 to 24.0 mm; and wherein the ends of the first portion of the pins and the ends of the second portion of the pins are spaced apart from the orifices and the second dimples respectively by approximately 0.8 to 24.0 mm.

14. The heat transfer device according to claim 11, further comprising:

the network of micro-channels having micro-channel passages each with a hydraulic diameter and a cross-sectional area;

each of the orifices having a diameter;

each of the orifices in association with the passages having a depth;

the first portion of the pins having ends spaced apart from and aligned with the first dimples, the ends spaced apart from the first dimples by a height;

the first portion of the pins and the second portion of the pins at least in part defining main channels, each of the main channels having a cross-sectional area; and each of the first dimples having a depth and a diameter.

15. The heat transfer device according to claim 14, wherein a ratio of the cross-sectional area of the passages to the cross sectional area of the main channels is in a range of approximately $5\times10^{-6}$ to $2\times10^{-1}$.

16. The heat transfer device according to claim 14, wherein a ratio of the depth of the first dimples to the diameter of the first dimples is in a range of approximately 0.1 to 0.5.

17. The heat transfer device according to claim 14, wherein a ratio of the height to the diameter of the first dimples is in a range of approximately $5\times10^{-2}$ to 6.

18. The heat transfer device according to claim 14, wherein a ratio of the diameter of the orifices to the diameter of the first dimples is in a range of approximately 0.1 to 0.7.

19. The heat transfer device according to claim 14, wherein a ratio of the depth of the orifices to the depth of the first dimples is in a range of approximately −0.5 to 3.0.

* * * * *